US010490199B2

(12) United States Patent
Liu et al.

(10) Patent No.: US 10,490,199 B2
(45) Date of Patent: Nov. 26, 2019

(54) BANDWIDTH EXTENSION AUDIO DECODING METHOD AND DEVICE FOR PREDICTING SPECTRAL ENVELOPE

(71) Applicant: Huawei Technologies Co., Ltd., Shenzhen (CN)

(72) Inventors: Zexin Liu, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/894,517

(22) Filed: Feb. 12, 2018

(65) Prior Publication Data

US 2018/0166085 A1 Jun. 14, 2018

Related U.S. Application Data

(60) Division of application No. 14/952,902, filed on Nov. 25, 2015, now Pat. No. 9,892,739, which is a (Continued)

(30) Foreign Application Priority Data

May 31, 2013 (CN) ..... 2013 1 0213593

(51) Int. Cl.
*G10L 21/038* (2013.01)
*G10L 19/08* (2013.01)
(Continued)

(52) U.S. Cl.
CPC ..... *G10L 19/0204* (2013.01); *G10L 19/002* (2013.01); *G10L 19/06* (2013.01);
(Continued)

(58) Field of Classification Search
CPC ..... G10L 19/02; G10L 19/08; G10L 19/12; G10L 21/038; G10L 21/0388
(Continued)

(56) References Cited

U.S. PATENT DOCUMENTS 5,455,888 A 10/1995 Iyengar et al.
6,862,567 B1 * 3/2005 Gao ..... G10L 21/0208 704/225
(Continued)

FOREIGN PATENT DOCUMENTS

CN 1535459 A 10/2004
CN 101023470 A 8/2007
(Continued)

OTHER PUBLICATIONS

"G.729.1", Wikipedia, 1 Page, downloaded Jan. 15, 2019. (Year: 2019).*
(Continued)

*Primary Examiner* — Martin Lerner
(74) *Attorney, Agent, or Firm* — Slater Matsil, LLP

(57) ABSTRACT

A signal decoding method and device, where the method includes decoding a bit stream of a voice signal or an audio signal to acquire a decoded signal, predicting an excitation signal of an extension band according to the decoded signal, where the extension band is adjacent to a band of the decoded signal, and the band of the decoded signal is lower than the extension band; selecting a first band and a second band from the decoded signal, and predicting a spectral envelope of the extension band according to a spectral coefficient of the first band and a spectral coefficient of the second band; and determining a frequency-domain signal of the extension band according to the spectral envelope of the extension band and the excitation signal of the extension band.

4 Claims, 7 Drawing Sheets

Related U.S. Application Data continuation of application No. PCT/CN2013/084514, filed on Sep. 27, 2013.

(51) Int. Cl.

| | |
|---|---|
| ***G10L 21/0388*** | (2013.01) |
| ***G10L 19/02*** | (2013.01) |
| ***G10L 19/002*** | (2013.01) |
| ***G10L 19/06*** | (2013.01) |
| *G10L 19/107* | (2013.01) |
| *G10L 19/24* | (2013.01) |

(52) U.S. Cl.

CPC ..... *G10L 19/08* (2013.01); *G10L 21/038* (2013.01); *G10L 19/107* (2013.01); *G10L 19/24* (2013.01)

(58) Field of Classification Search

USPC ..... 704/205, 206, 207, 219, 500, 501

See application file for complete search history.

(56) References Cited

U.S. PATENT DOCUMENTS

| | | | | |
|---|---|---|---|---|
| 8,706,483 | B2 * | 4/2014 | Gerl | G10L 21/0208 704/226 |
| 8,805,695 | B2 | 8/2014 | Liu et al. | |
| 8,856,011 | B2 | 10/2014 | Sverrisson et al. | |
| 9,666,201 | B2 | 5/2017 | Liu et al. | |
| 9,892,739 | B2 * | 2/2018 | Liu | G10L 19/0204 |
| 2003/0009327 | A1 | 1/2003 | Nilsson et al. | |
| 2004/0243402 | A1 | 12/2004 | Ozawa | |
| 2006/0190254 | A1 * | 8/2006 | Iser | G10L 21/038 704/243 |
| 2007/0282599 | A1 | 12/2007 | Choo et al. | |
| 2008/0126081 | A1 * | 5/2008 | Geiser | G10L 21/038 704/201 |
| 2008/0281587 | A1 | 11/2008 | Yoshida | |
| 2009/0030699 | A1 * | 1/2009 | Iser | G10L 21/038 704/500 |
| 2010/0036659 | A1 * | 2/2010 | Haulick | G10L 19/012 704/226 |
| 2010/0121646 | A1 | 5/2010 | Ragot et al. | |
| 2010/0198587 | A1 | 8/2010 | Ramabadran et al. | |
| 2011/0173004 | A1 * | 7/2011 | Bessette | G10L 19/005 704/500 |
| 2011/0231195 | A1 * | 9/2011 | Nongpiur | G10L 21/038 704/500 |
| 2011/0238425 | A1 * | 9/2011 | Neuendorf | G10L 19/008 704/500 |
| 2012/0010880 | A1 * | 1/2012 | Nagel | G10L 19/18 704/205 |
| 2012/0095758 | A1 | 4/2012 | Gibbs et al. | |
| 2012/0185256 | A1 | 7/2012 | Virette et al. | |
| 2012/0316887 | A1 | 12/2012 | Oh et al. | |
| 2013/0018660 | A1 | 1/2013 | Qi et al. | |
| 2013/0110507 | A1 * | 5/2013 | Gao | G10L 19/24 704/219 |
| 2013/0132099 | A1 * | 5/2013 | Oshikiri | G10L 19/008 704/500 |
| 2013/0185082 | A1 * | 7/2013 | Nagel | G10L 21/038 704/500 |
| 2013/0226565 | A1 | 8/2013 | Sung et al. | |
| 2013/0262122 | A1 | 10/2013 | Kim et al. | |
| 2013/0317812 | A1 | 11/2013 | Jeong et al. | |
| 2013/0317831 | A1 | 11/2013 | Liu et al. | |
| 2016/0196829 | A1 | 7/2016 | Liu | |
| 2016/0210979 | A1 | 7/2016 | Liu et al. | |
| 2017/0249948 | A1 | 8/2017 | Liu et al. | |

FOREIGN PATENT DOCUMENTS

| | | | |
|---|---|---|---|
| CN | 101083076 | A | 12/2007 |
| CN | 102308333 | A | 1/2012 |
| CN | 102456349 | A | 5/2012 |
| CN | 102637434 | A | 8/2012 |

OTHER PUBLICATIONS

"Series G: Transmission System and Media, Digital Systems and Networks; Digital terminal equipments—Coding of analogue signals by methods other than PCM—G.729-based embedded variable bit-rate coder: An 8-32 kbit/s scalable wideband coder bitstream interoperable with G.729," ITU-T Telecommunication Standardization Sector of ITU-T, G.729.1, May 2006, 98 pages.

Jax, P. et al., "On Artificial Bandwidth Extension of Telephone Speech," Elsevier, Signal Processing, www.ComputerScienceWeb.com, vol. 83, No. 8, XP008155328, Aug. 1, 2003, 13 pages.

* cited by examiner

BANDWIDTH EXTENSION AUDIO DECODING METHOD AND DEVICE FOR PREDICTING SPECTRAL ENVELOPE

CROSS-REFERENCE TO RELATED APPLICATIONS

This application is a divisional of U.S. patent application Ser. No. 14/952,902, filed on Nov. 25, 2015, now U.S. Pat. No. 9,892,739, which is a continuation of International Application No. PCT/CN2013/084514, filed on Sep. 27, 2013, which claims priority to Chinese Patent Application No. 201310213593.5, filed on May 31, 2013. All of the afore-mentioned patent applications are hereby incorporated by reference in their entireties.

TECHNICAL FIELD

The present invention relates to the field of information technologies, and in particular, to a signal decoding method and device.

BACKGROUND

In current communication transmission, more attention is paid to the quality of voice or audio, and therefore encoding and decoding of a voice signal or an audio signal is becoming a more important procedure in voice or audio signal processing.

In a signal encoding process, in order to improve encoding efficiency, an encoder end generally expects to use as few coded bits as possible to represent a signal to be transmitted. For example, during low-rate encoding, the encoder end usually does not perform encoding on all bands. Considering a feature that human ears are more sensitive to a low-frequency part than to a high-frequency part in a voice signal or an audio signal, generally, more bits are allocated to the low-frequency part for encoding, while only a few bits are allocated to the high-frequency part for encoding; in some cases, the high-frequency part is even not encoded. Therefore, during decoding on a decoder end, a band on which encoding is not performed needs to be restored by means of a blind bandwidth expansion technology.

At present, the decoder end usually uses a time-domain bandwidth extension manner to restore the band on which encoding is not performed. However, in this manner, an extension effect of a voice signal is poor, and an audio signal cannot be processed, and consequently an output voice or audio signal has poor performance.

SUMMARY

Embodiments of the present invention provide a signal decoding method and device, which can improve performance of a voice signal or an audio signal.

According to a first aspect, a signal decoding method is provided, including: decoding a bit stream of a voice signal or an audio signal, to acquire a decoded signal; predicting an excitation signal of an extension band according to the decoded signal, where the extension band is adjacent to a band of the decoded signal, and the band of the decoded signal is lower than the extension band; selecting a first band and a second band from the decoded signal, and predicting a spectral envelope of the extension band according to a spectral coefficient of the first band and a spectral coefficient of the second band, where a distance from a highest frequency bin of the first band to a lowest frequency bin of the extension band is less than or equal to a first value, and a distance from a highest frequency bin of the second band to a lowest frequency bin of the first band is less than or equal to a second value; and determining a frequency-domain signal of the extension band according to the spectral envelope of the extension band and the excitation signal of the extension band.

With reference to the first aspect, in a first possible implementation manner, the selecting a first band and a second band from the decoded signal includes: according to a direction from a start point of the extension band to a low frequency, selecting the first band and the second band from the band of the decoded signal, where the distance from the highest frequency bin of the first band to the lowest frequency bin of the extension band is equal to the first value, and the first value is 0; and the distance from the highest frequency bin of the second band to the lowest frequency bin of the first band is equal to the second value, and the second value is 0.

With reference to the first aspect or the first possible implementation manner of the first aspect, in a second possible implementation manner, the predicting a spectral envelope of the extension band according to a spectral coefficient of the first band and a spectral coefficient of the second band includes: dividing the first band into M subbands, and determining a mean value of energy or amplitude of each subband according to the spectral coefficient of the first band, where M is a positive integer; determining an adjusted value of the energy or amplitude of each subband according to the mean value of the energy or amplitude of each subband; predicting a first spectral envelope of the extension band according to the adjusted value of the energy or amplitude of each subband; determining a mean value of energy or amplitude of the second band according to the spectral coefficient of the second band; and predicting the spectral envelope of the extension band according to the first spectral envelope of the extension band and the mean value of the energy or amplitude of the second band.

With reference to the second possible implementation manner of the first aspect, in a third possible implementation manner, the determining an adjusted value of the energy or amplitude of each subband according to the mean value of the energy or amplitude of each subband includes: if a variance of mean values of energy or amplitude of the M subbands is not within a preset threshold range, adjusting a mean value of energy or amplitude of each subband in a subbands to determine an adjusted value of the energy or amplitude of each subband in the a subbands, and using a mean value of energy or amplitude of each subband in b subbands as an adjusted value of the energy or amplitude of each subband in the b subbands, where the mean value of the energy or amplitude of each subband in the a subbands is greater than or equal to a mean value threshold, the mean value of the energy or amplitude of each subband in the b subbands is less than the mean value threshold, a and b are positive integers, and a+b=M; or if a variance of mean values of energy or amplitude of the M subbands is within a preset threshold range, using the mean value of the energy or amplitude of each subband as the adjusted value of the energy or amplitude of each subband.

With reference to the second possible implementation manner of the first aspect, in a fourth possible implementation manner, the determining an adjusted value of the energy or amplitude of each subband according to the mean value of the energy or amplitude of each subband includes: for the $i^{th}$ subband and the $(i+1)^{th}$ subband in the M subbands, if a ratio between a mean value of energy or amplitude of the $i^{th}$ subband and a mean value of energy or amplitude of the $(i+1)^{th}$ subband is not within a preset threshold range, when the mean value of the energy or amplitude of the $i^{th}$ subband is greater than the mean value of the energy or amplitude of the $(i+1)^{th}$ subband, adjusting the mean value of the energy or amplitude of the $i^{th}$ subband to determine an adjusted value of the energy or amplitude of the $i^{th}$ subband, and using the mean value of the energy or amplitude of the $(i+1)^{th}$ subband as an adjusted value of the energy or amplitude of the $(i+1)^{th}$ subband; or when the mean value of the energy or amplitude of the $i^{th}$ subband is less than the mean value of the energy or amplitude of the $(i+1)^{th}$ subband, adjusting the mean value of the energy or amplitude of the $(i+1)^{th}$ subband to determine an adjusted value of the energy or amplitude of the $(i+1)^{th}$ subband, and using the mean value of the energy or amplitude of the $i^{th}$ subband as an adjusted value of the energy or amplitude of the $i^{th}$ subband; or if a ratio between a mean value of energy or amplitude of the $i^{th}$ subband and a mean value of energy or amplitude of the $(i+1)^{th}$ subband is within a preset threshold range, using the mean value of the energy or amplitude of the $i^{th}$ subband as an adjusted value of the energy or amplitude of the $i^{th}$ subband, and using the mean value of the energy or amplitude of the $(i+1)^{th}$ subband as an adjusted value of the $(i+1)^{th}$ subband, where i is a positive integer, and $1 \le i \le M-1$.

With reference to the second possible implementation manner of the first aspect or the third possible implementation manner of the first aspect or the fourth possible implementation manner of the first aspect, in a fifth possible implementation manner, the predicting the spectral envelope of the extension band according to the first spectral envelope of the extension band and the mean value of the energy or amplitude of the second band includes: determining a second spectral envelope of an extension band of a current frame according to a first spectral envelope of the extension band of the current frame and a mean value of energy or amplitude of a second band of the current frame; in a case in which it is determined that a preset condition is satisfied, weighting the second spectral envelope of the extension band of the current frame and a spectral envelope of an extension band of a previous frame, to determine a spectral envelope of the extension band of the current frame; or in a case in which it is determined that a preset condition is not satisfied, using the second spectral envelope of the extension band of the current frame as a spectral envelope of the extension band of the current frame.

With reference to the second possible implementation manner of the first aspect or the third possible implementation manner of the first aspect or the fourth possible implementation manner of the first aspect, in a sixth possible implementation manner, the predicting the spectral envelope of the extension band according to the first spectral envelope of the extension band and the mean value of the energy or amplitude of the second band includes: determining a second spectral envelope of an extension band of a current frame according to a first spectral envelope of the extension band of the current frame and a mean value of energy or amplitude of a second band of the current frame; in a case in which it is determined that a preset condition is satisfied, weighting the second spectral envelope of the extension band of the current frame and a spectral envelope of an extension band of a previous frame, to determine a third spectral envelope of the extension band of the current frame; or in a case in which it is determined that a preset condition is not satisfied, using the second spectral envelope of the extension band of the current frame as a third spectral envelope of the extension band of the current frame; and determining a spectral envelope of the extension band of the current frame according to a pitch period of the decoded signal, a voicing factor of the decoded signal and the third spectral envelope of the extension band of the current frame.

With reference to the fifth possible implementation manner of the first aspect or the sixth possible implementation manner of the first aspect, in a seventh possible implementation manner, the preset condition includes at least one of the following three conditions: condition 1: a coding mode of a voice signal or an audio signal of the current frame is different from a coding mode of a voice signal or an audio signal of the previous frame; condition 2: a decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers; and condition 3: the decoded signal of the current frame is non-fricative, and a ratio between the second spectral envelope of the extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

With reference to the first aspect or any implementation manner of the first possible implementation manner of the first aspect to the seventh possible implementation manner of the first aspect, in an eighth possible implementation manner, the predicting an excitation signal of an extension band according to the decoded signal includes: in a case in which the coding mode of the voice or audio signal is a time-domain coding mode, selecting a third band from the decoded signal, where the third band is adjacent to the extension band; and predicting the excitation signal of the extension band according to a spectral coefficient of the third band.

With reference to the first aspect or any implementation manner of the first possible implementation manner of the first aspect to the seventh possible implementation manner of the first aspect, in a ninth possible implementation manner, the predicting an excitation signal of an extension band according to the decoded signal includes: in a case in which the coding mode of the voice or audio signal is a time-frequency joint coding mode or a frequency-domain coding mode, selecting a fourth band from the decoded signal, where a quantity of bits allocated to the fourth band is greater than a preset bit quantity threshold; and predicting the excitation signal of the extension band according to a spectral coefficient of the fourth band.

With reference to the first aspect or any implementation manner of the first possible implementation manner of the first aspect to the ninth possible implementation manner of the first aspect, in a tenth possible implementation manner, the method further includes: in a case in which the coding mode of the voice or audio signal is the time-frequency joint coding mode or the frequency-domain coding mode, synthesizing the decoded signal and the frequency-domain signal of the extension band, to acquire a frequency-domain output signal; and performing frequency-time transformation on the frequency-domain output signal, to acquire a final output signal.

With reference to the first aspect or any implementation manner of the first possible implementation manner of the first aspect to the ninth possible implementation manner of the first aspect, in an eleventh possible implementation manner, the method further includes: in a case in which the coding mode of the voice or audio signal is the time-domain coding mode, acquiring a first time-domain signal of the extension band in a time-domain bandwidth extension manner; transforming the frequency-domain signal of the extension band into a second time-domain signal of the extension band; synthesizing the first time-domain signal of the extension band and the second time-domain signal of the extension band, to acquire a final time-domain signal of the extension band; and synthesizing the decoded signal and the final time-domain signal of the extension band, to acquire a final output signal.

According to a second aspect, a signal decoding device is provided, including: a decoding unit, configured to decode a bit stream of a voice signal or an audio signal, to acquire a decoded signal; the predicting unit, configured to receive the decoded signal from the decoding unit, and predict an excitation signal of an extension band according to the decoded signal, where the extension band is adjacent to a band of the decoded signal, and the band of the decoded signal is lower than the extension band, where the predicting unit is further configured to select a first band and a second band from the decoded signal, and predict a spectral envelope of the extension band according to a spectral coefficient of the first band and a spectral coefficient of the second band, where a distance from a highest frequency bin of the first band to a lowest frequency bin of the extension band is less than or equal to a first value, and a distance from a highest frequency bin of the second band to a lowest frequency bin of the first band is less than or equal to a second value; and the determining unit, configured to receive, from the predicting unit, the spectral envelope of the extension band and the excitation signal of the extension band, and determine a frequency-domain signal of the extension band according to the spectral envelope of the extension band and the excitation signal of the extension band.

With reference to the second aspect, in a first possible implementation manner, the predicting unit is specifically configured to: according to a direction from a start point of the extension band to a low frequency, select the first band and the second band from the decoded signal, where the distance from the highest frequency bin of the first band to the lowest frequency bin of the extension band is equal to the first value, and the first value is 0; and the distance from the highest frequency bin of the second band to the lowest frequency bin of the first band is equal to the second value, and the second value is 0.

With reference to the second aspect or the first possible implementation manner of the second aspect, in a second possible implementation manner, the predicting unit is specifically configured to divide the first band into M subbands, and determine a mean value of energy or amplitude of each subband according to the spectral coefficient of the first band, where M is a positive integer; determine an adjusted value of the energy or amplitude of each subband according to the mean value of the energy or amplitude of each subband; predict a first spectral envelope of the extension band according to the adjusted value of the energy or amplitude of each subband; determine a mean value of energy or amplitude of the second band according to the spectral coefficient of the second band; and predict the spectral envelope of the extension band according to the first spectral envelope of the extension band and the mean value of the energy or amplitude of the second band.

With reference to the second possible implementation manner of the second aspect, in a third possible implementation manner, the predicting unit is specifically configured to: if a variance of mean values of energy or amplitude of the M subbands is not within a preset threshold range, adjust a mean value of energy or amplitude of each subband in a subbands to determine an adjusted value of the energy or amplitude of each subband in the a subbands, and use a mean value of energy or amplitude of each subband in b subbands as an adjusted value of the energy or amplitude of each subband in the b subbands, where the mean value of the energy or amplitude of each subband in the a subbands is greater than or equal to a mean value threshold, the mean value of the energy or amplitude of each subband in the b subbands is less than the mean value threshold, a and b are positive integers, and a+b=M; or if a variance of mean values of energy or amplitude of the M subbands is within a preset threshold range, use the mean value of the energy or amplitude of each subband as the adjusted value of the energy or amplitude of each subband.

With reference to the second possible implementation manner of the second aspect, in fourth possible implementation manner, the predicting unit is specifically configured to: for the $i^{th}$ subband and the $(i+1)^{th}$ subband in the M subbands, if a ratio between a mean value of energy or amplitude of the $i^{th}$ subband and a mean value of energy or amplitude of the $(i+1)^{th}$ subband is not within a preset threshold range, when the mean value of the energy or amplitude of the $i^{th}$ subband is greater than the mean value of the energy or amplitude of the $(i+1)^{th}$ subband, adjust the mean value of the energy or amplitude of the $i^{th}$ subband to determine an adjusted value of the energy or amplitude of the $i^{th}$ subband, and use the mean value of the energy or amplitude of the $(i+1)^{th}$ subband as an adjusted value of the energy or amplitude of the $(i+1)^{th}$ subband; or when the mean value of the energy or amplitude of the $i^{th}$ subband is less than the mean value of the energy or amplitude of the $(i+1)^{th}$ subband, adjust the mean value of the energy or amplitude of the $(i+1)^{th}$ subband to determine an adjusted value of the energy or amplitude of the $(i+1)^{th}$ subband, and use the mean value of the energy or amplitude of the $i^{th}$ subband as an adjusted value of the energy or amplitude of the $i^{th}$ subband; or if a ratio between a mean value of energy or amplitude of the $i^{th}$ subband and a mean value of energy or amplitude of the $(i+1)^{th}$ subband is within a preset threshold range, use the mean value of the energy or amplitude of the $i^{th}$ subband as an adjusted value of the energy or amplitude of the $i^{th}$ subband, and use the mean value of the energy or amplitude of the $(i+1)^{th}$ subband as an adjusted value of the $(i+1)^{th}$ subband, where i is a positive integer, and $1 \le i \le M-1$.

With reference to the second possible implementation manner of the second aspect or the third possible implementation manner of the second aspect or the fourth possible implementation manner of the second aspect, in a fifth possible implementation manner, the predicting unit is specifically configured to: determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a spectral envelope of the extension band of the current frame; or in a case in which it is determined that a preset condition is not satisfied, use the second spectral envelope of the extension band of the current frame as a spectral envelope of the extension band of the current frame.

With reference to the second possible implementation manner of the second aspect or the third possible implementation manner of the second aspect or the fourth possible implementation manner of the second aspect, in a sixth possible implementation manner, the predicting unit is specifically configured to: determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a third spectral envelope of the extension band of the current frame; or in a case in which it is determined that a preset condition is not satisfied, use the second spectral envelope of the extension band of the current frame as a third spectral envelope of the extension band of the current frame; and determine a spectral envelope of the extension band of the current frame according to a pitch period of the decoded signal, a voicing factor of the decoded signal and the third spectral envelope of the extension band of the current frame.

With reference to the fifth possible implementation manner of the second aspect or the sixth possible implementation manner of the second aspect, in a seventh possible implementation manner, the preset condition includes at least one of the following three conditions: condition 1: a coding mode of a voice signal or an audio signal of the current frame is different from a coding mode of a voice signal or an audio signal of the previous frame; condition 2: a decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers; and condition 3: the decoded signal of the current frame is non-fricative, and a ratio between the second spectral envelope of the extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

With reference to the second aspect or any implementation manner of the first possible implementation manner of the second aspect to the seventh possible implementation manner of the second aspect, in an eighth possible implementation manner, the predicting unit is specifically configured to: in a case in which the coding mode of the voice or audio signal is a time-domain coding mode, select a third band from the decoded signal, where the third band is adjacent to the extension band; and predict the excitation signal of the extension band according to a spectral coefficient of the third band.

With reference to the second aspect or any implementation manner of the first possible implementation manner of the second aspect to the seventh possible implementation manner of the second aspect, in a ninth possible implementation manner, the predicting unit is specifically configured to: in a case in which the coding mode of the voice or audio signal is a time-frequency joint coding mode or a frequency-domain coding mode, select a fourth band from the decoded signal, where a quantity of bits allocated to the fourth band is greater than a preset bit quantity threshold; and predict the excitation signal of the extension band according to a spectral coefficient of the fourth band.

With reference to the second aspect or any implementation manner of the first possible implementation manner of the second aspect to the ninth possible implementation manner of the second aspect, in a tenth possible implementation manner, a first synthesizing unit is configured to: in a case in which the coding mode of the voice or audio signal is the time-frequency joint coding mode or the frequency-domain coding mode, synthesize the decoded signal and the frequency-domain signal of the extension band, to acquire a frequency-domain output signal; and a first transforming unit is configured to perform frequency-time transformation on the frequency-domain output signal, to acquire a final output signal.

With reference to the second aspect or any implementation manner of the first possible implementation manner of the second aspect to the ninth possible implementation manner of the second aspect, in an eleventh possible implementation manner, an acquiring unit is configured to: in a case in which the coding mode of the voice or audio signal is the time-domain coding mode, acquire a first time-domain signal of the extension band in a time-domain bandwidth extension manner; a second transforming unit is configured to transform the frequency-domain signal of the extension band into a second time-domain signal of the extension band; and a second synthesizing unit is configured to synthesize the first time-domain signal of the extension band and the second time-domain signal of the extension band, to acquire a final time-domain signal of the extension band, where the second synthesizing unit is further configured to synthesize the decoded signal and the final time-domain signal of the extension band, to acquire a final output signal.

According to a third aspect, a signal encoding method is provided, including: performing core layer encoding on a voice signal or an audio signal, to obtain a core layer bit stream of the voice or audio signal; performing extension layer processing on the voice or audio signal to determine a first envelope of an extension band; determining a second envelope of the extension band according to a signal-to-noise ratio of the voice or audio signal, a pitch period of the voice or audio signal, and the first envelope of the extension band; encoding the second envelope to obtain an extension layer bit stream; and sending the core layer bit stream and the extension layer bit stream to a decoder end.

According to a fourth aspect, a signal decoding method is provided, including: receiving, from an encoder end, a core layer bit stream and an extension layer bit stream of a voice signal or an audio signal; decoding the extension layer bit stream to determine a second envelope of an extension band, where the second envelope is determined by the encoder end according to a signal-to-noise ratio of the voice or audio signal, a pitch period of the voice or audio signal, and a first envelope of the extension band; decoding the core layer bit stream, to obtain a core layer voice or audio signal; predicting an excitation signal of the extension band according to the core layer voice or audio signal; and predicting a signal of the extension band according to the excitation signal of the extension band and the second envelope of the extension band.

According to a fifth aspect, a signal encoding device is provided, including: an encoding unit, configured to perform core layer encoding on a voice signal or an audio signal, to obtain a core layer bit stream of the voice or audio signal; a first determining unit, configured to perform extension layer processing on the voice or audio signal to determine a first envelope of an extension band; a second determining unit, configured to determine a second envelope of the extension band according to a signal-to-noise ratio of the voice or audio signal, a pitch period of the voice or audio signal, and the first envelope of the extension band, where the encoding unit is further configured to encode the second envelope to obtain an extension layer bit stream; and a sending unit, configured to send the core layer bit stream and the extension layer bit stream to a decoder end.

According to a sixth aspect, a signal decoding device is provided, including: a receiving unit, configured to receive, from an encoder end, a core layer bit stream and an extension layer bit stream of a voice signal or an audio signal; a decoding unit, configured to decode the extension layer bit stream to determine a second envelope of an extension band, where the second envelope is determined by the encoder end according to a signal-to-noise ratio of the voice or audio signal, a pitch period of the voice or audio signal, and a first envelope of the extension band, where the decoding unit is further configured to decode the core layer bit stream, to obtain a core layer voice or audio signal; and a predicting unit, configured to predict an excitation signal of the extension band according to the core layer voice or audio signal, where the predicting unit is further configured to predict a signal of the extension band according to the excitation signal of the extension band and the second envelope of the extension band.

In the embodiments of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

BRIEF DESCRIPTION OF THE DRAWINGS

To describe the technical solutions in the embodiments of the present invention more clearly, the following briefly introduces the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

Figure 1:
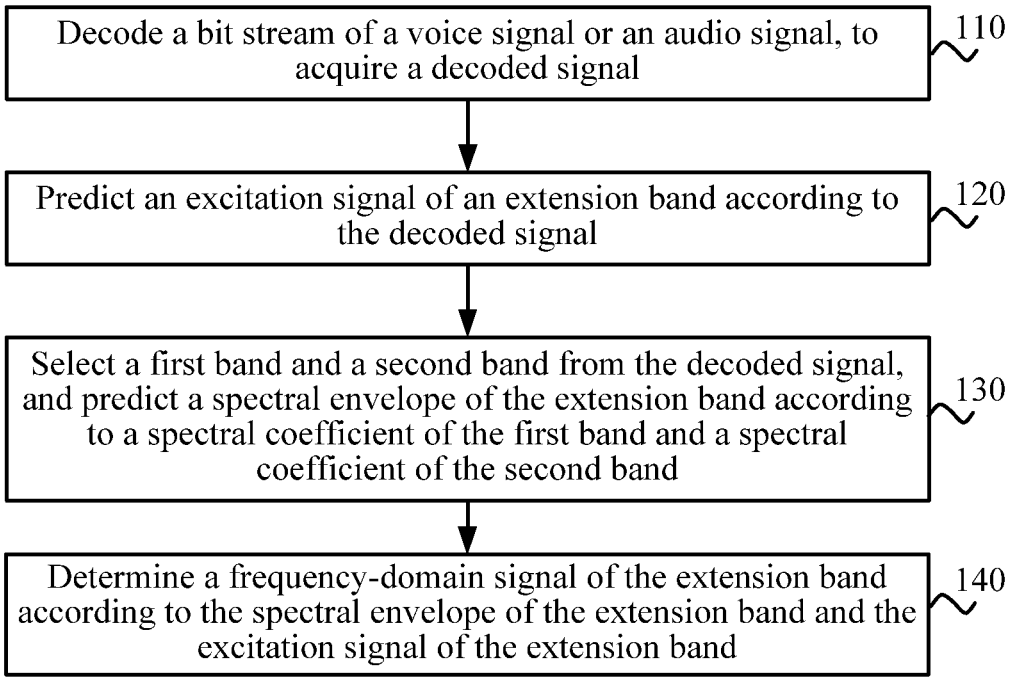
FIG. 1 is a schematic flowchart of a signal decoding method according to an embodiment of the present invention.

FIG. 1 is a schematic flowchart of a signal decoding method according to an embodiment of the present invention. The method in FIG. 1 is executed by a signal decoding device, which, for example, may be a decoder.

110: Decode a bit stream of a voice signal or an audio signal, to acquire a decoded signal.

For example, the bit stream of the voice or audio signal is obtained by encoding an original voice or audio signal using a signal encoding device (such as an encoder). After acquiring the bit stream of the voice or audio signal, the signal decoding device may decode the bit stream to obtain the decoded signal. For a decoding process, reference may be made to a process in the prior art; to prevent repetition, details are not described herein again. The decoded signal may be a low-band decoded signal.

For example, if a coding mode of the voice signal is a time-domain coding mode, the signal decoding device may decode the bit stream of the voice signal in a corresponding decoding mode. If a coding mode of the audio signal is a time-domain joint coding mode or a frequency-domain coding mode, the signal decoding device may decode the bit stream of the audio signal in a corresponding decoding mode.

120: Predict an excitation signal of an extension band according to the decoded signal, where a band of the decoded signal is lower than the extension band, and the band of the decoded signal is lower than the extension band.

Optionally, as an embodiment, in a case in which the coding mode of the voice or audio signal is the time-domain coding mode, the signal decoding device may select a third band from the decoded signal, where the third band is adjacent to the extension band. The excitation signal of the extension band may be predicted according to a spectral coefficient of the third band.

Specifically, in a case in which the coding mode of the voice or audio signal is the time-domain coding mode, the signal decoding device may predict the excitation signal of the extension band according to the spectral coefficient of the third band that is adjacent to the extension band.

Optionally, as another embodiment, in a case in which the coding mode of the voice or audio signal is the time-frequency joint coding mode or the frequency-domain coding mode, the signal decoding device may select a fourth band from the decoded signal, where a quantity of bits allocated to the fourth band is greater than a preset bit quantity threshold. The excitation signal of the extension band may be predicted according to a spectral coefficient of the fourth band.

Specifically, if a relatively large quantity of bits are allocated to the fourth band, the fourth band is restored well during decoding. Therefore, the signal decoding device may predict the excitation signal of the extension band according to the spectral coefficient of the fourth band.

130: Select a first band and a second band from the decoded signal, and predict a spectral envelope of the extension band according to a spectral coefficient of the first band and a spectral coefficient of the second band, where a distance from a highest frequency bin of the first band to a lowest high frequency bin of the extension band is less than or equal to a first value, and a distance from a highest frequency bin of the second band to a lowest high frequency bin of the first band is less than or equal to a second value.

In this embodiment, the extension band may be a band that needs to be extended. For example, when the encoder performs encoding by using an ACELP (Algebraic Codebook Excited Linear Prediction, algebraic codebook excited linear prediction) coding mode, in order to improve coding efficiency, a bandwidth signal having a sampling rate of 16 kHz may be downsampled to be a signal having a sampling rate of 12.8 kHz, and then the signal is encoded. In this way, after the signal decoding device decodes the bit stream, bandwidth of the decoded signal that is obtained is 6.4 kHz. To obtain an output signal having a bandwidth of 8 kHz, the signal decoding device may extend a band of 6 kHz to 8 kHz, that is, a signal on the band of 6 kHz to 8 kHz is obtained by means of extension. To obtain an output signal having a bandwidth of 14 kHz, the signal decoding device may extend a band of 6.4 kHz to 14 kHz, that is, a signal on the band of 6.4 kHz to 14 kHz is obtained by means of extension.

It should be understood that, in this embodiment of the present invention, the spectral envelope of the extension band may include N envelope values, where N is a positive integer, and a value of N may be determined according to an actual situation.

In a direction from a start point of the extension band to a low frequency, the first band and the second band may be selected from the decoded signal; when the selected first band and second band is close enough to the extension band, the extension band can be more precise (that is, closer to an actual signal). The first value and the second value are separately used to ensure that the first band is close enough to the extension band and the second band is close enough to the first band. The foregoing first value and second value may be positive integers or positive numbers, and may be expressed by using quantities of spectral coefficients or frequency bins, or expressed by using bandwidth. The first value and the second value may be equal or not equal. The first value and the second value may be set in advance according to a requirement, for example, the first value and the second value may be set based on a sampling rate and a quantity of samples during time-frequency transformation of the voice or audio signal. For example, 40 spectral coefficients represent 1 kHz, and the first value and the second value each may be 40, that is, a distance between the first band and the extension band may be within 1 kHz, and a distance between the second band and the first band may be within 1 kHz.

In an embodiment, the selecting a first band and a second band from the decoded signal includes: according to the direction from the start point of the extension band to the low frequency, selecting the first band and the second band from the band of the decoded signal, where the distance from the highest frequency bin of the first band to the lowest frequency bin of the extension band is equal to the first value, and the first value is 0; and the distance from the highest frequency bin of the second band to the lowest frequency bin of the first band is equal to the second value, and the second value is 0.

As an exemplary embodiment, the first value and the second value may be 0. In this case, the first band is adjacent to the extension band, and the second band is adjacent to the first band. Therefore, optionally, as an embodiment of step 130, the signal decoding device may select the first band and the second band from the decoded signal according to the direction from the start point of the extension band to the low frequency, where the first band may be adjacent to the extension band, and the second band may be adjacent to the first band. The signal decoding device may predict the spectral envelope of the extension band according to the spectral coefficient of the first band and the spectral coefficient of the second band.

Specifically, the signal decoding device may sequentially select, in the direction from the start point of the extension band to the low frequency, the first band and the second band from the band of the decoded signal. For example, assuming that the band of the decoded signal is 0 to 6.4 kHz and the extension band is 6 kHz to 8 kHz, the first band may be 4.8 kHz to 6.4 kHz, and the second band may be 3.2 kHz to 4.8 kHz. Assuming that the band of the decoded signal is 0 to 6.4 kHz and the extension band is 6.4 kHz to 14 kHz, the first band may be 4 kHz to 6.4 kHz, and the second band may be 3.2 kHz to 4 kHz. The foregoing examples of numerical values are used to help a person skilled in the art better understand this embodiment of the present invention, rather than limit the scope of the present invention. The first band and the second band may be selected according to an actual situation, which is not limited in this embodiment of the present invention.

Optionally, as another embodiment, the signal decoding device may divide the first band into M subbands, and determine a mean value of energy or amplitude of each subband according to the spectral coefficient of the first band, where M is a positive integer. An adjusted value of the energy or amplitude of each subband may be determined according to the mean value of the energy or amplitude of each subband. A first spectral envelope of the extension band may be predicted according to the adjusted value of the energy or amplitude of each subband. A mean value of energy or amplitude of the second band may be determined according to the spectral coefficient of the second band. The spectral envelope of the extension band may be determined according to the first spectral envelope of the extension band and the mean value of the energy or amplitude of the second band.

Specifically, the signal decoding device may divide the first band into M subbands, and determine the mean value of the energy or amplitude of each subband according to the spectral coefficient of the first band, that is, obtain M mean values of energy or amplitude. M adjusted values of energy or amplitude may be determined according to the M mean values of energy or amplitude.

The signal decoding device may predict the first spectral envelope of the extension band according to the M adjusted values of energy or amplitude. The first spectral envelope may be a preliminary prediction on the spectral envelope of the extension band. The first spectral envelope may include N values. The signal decoding device may predict the spectral envelope of the extension band according to the first spectral envelope of the extension band and the mean value of the energy or amplitude of the second band.

Optionally, as another embodiment, if a variance of mean values of energy or amplitude of the M subbands is not within a preset threshold range, a mean value of energy or amplitude of each subband in a subbands is adjusted to determine an adjusted value of the energy or amplitude of each subband in the a subbands, and a mean value of energy or amplitude of each subband in b subbands is used as an adjusted value of the energy or amplitude of each subband in the b subbands, where the mean value of the energy or amplitude of each subband in the a subbands is greater than or equal to a mean value threshold, the mean value of the energy or amplitude of each subband in the b subbands is less than the mean value threshold, a and b are positive integers, and a+b=M; or if a variance of mean values of energy or amplitude of the M subbands is within a preset threshold range, the mean value of the energy or amplitude of each subband is used as the adjusted value of the energy or amplitude of each subband.

Specifically, when the variance of the M mean values of energy or amplitude is not within the preset threshold range, values that are in the M mean values of energy or amplitude and greater than the mean value threshold may be adjusted. It should be noted that, the threshold range may be determined according to the variance of the M mean values of energy or amplitude, and the mean value threshold may be determined according to the M mean values of energy or amplitude. For example, the mean value threshold may be an average value of the M mean values, and mean values of energy or amplitude that are in the M mean values of energy or amplitude and greater than the average value may be scaled to obtain corresponding adjusted values. A scaling process may be multiplying the mean values, which need to be adjusted, by a scaling ratio value, where the scaling ratio value may be obtained according to the mean values of the energy or amplitude of the M subbands, and the scaling ratio value is less than 1.

Optionally, as another embodiment, for the $i^{th}$ subband and the $(i+1)^{th}$ subband in the M subbands, if a ratio between a mean value of energy or amplitude of the $i^{th}$ subband and a mean value of energy or amplitude of the $(i+1)^{th}$ subband is not within a preset threshold range, when the mean value of the energy or amplitude of the $i^{th}$ subband is greater than the mean value of the energy or amplitude of the $(i+1)^{th}$ subband, the mean value of the energy or amplitude of the $i^{th}$ subband is adjusted to determine an adjusted value of the energy or amplitude of the $i^{th}$ subband, and the mean value of the energy or amplitude of the $(i+1)^{th}$ subband is used as an adjusted value of the energy or amplitude of the $(i+1)^{th}$ subband; or when the mean value of the energy or amplitude of the $i^{th}$ subband is less than the mean value of the energy or amplitude of the $(i+1)^{th}$ subband, the mean value of the energy or amplitude of the $(i+1)^{th}$ subband is adjusted to determine an adjusted value of the energy or amplitude of the $(i+1)^{th}$ subband, and the mean value of the energy or amplitude of the $i^{th}$ subband is used as an adjusted value of the energy or amplitude of the $i^{th}$ subband; or if a ratio between a mean value of energy or amplitude of the $i^{th}$ subband and a mean value of energy or amplitude of the $(i+1)^{th}$ subband is within a preset threshold range, the mean value of the energy or amplitude of the $i^{th}$ subband is used as an adjusted value of the energy or amplitude of the $i^{th}$ subband, and the mean value of the energy or amplitude of the $(i+1)^{th}$ subband is used as an adjusted value of the $(i+1)^{th}$ subband, where i is a positive integer, and $1 \leq M \leq 1$.

Specifically, if the ratio between the mean value of the energy or amplitude of the $i^{th}$ subband and the mean value of the energy or amplitude of the $(i+1)^{th}$ subband is not within the preset threshold range, a greater one of the mean value of the energy or amplitude of the $i^{th}$ subband and the mean value of the energy or amplitude of the $(i+1)^{th}$ subband is adjusted to obtain a corresponding adjusted value, for example, a greater mean value of the two mean values may be scaled, for example, the greater mean value may be multiplied by a scaling ratio value.

Optionally, as another embodiment, the signal decoding device may determine a second spectral envelope of an extension band of a current frame according to a first spectral envelope of the extension band of the current frame and a mean value of energy or amplitude of a second band of the current frame. In a case in which it is determined that a preset condition is satisfied, the second spectral envelope of the extension band of the current frame and a spectral envelope of an extension band of a previous frame may be weighted, to determine a spectral envelope of the extension band of the current frame. In a case in which it is determined that a preset condition is not satisfied, the second spectral envelope of the extension band of the current frame is used as a spectral envelope of the extension band of the current frame.

It should be understood that, all the processes described in FIG. 1 are with respect to the current frame. Therefore, the spectral envelope of the extension band that the signal decoding device needs to predict is also the spectral envelope of the extension band of the current frame.

Specifically, the signal decoding device may determine the second spectral envelope of the extension band according to the first spectral envelope of the extension band and the mean value of the energy or amplitude of the second band. For example, the signal decoding device may separately scale N values included in the first spectral envelope when a ratio between the mean value of the energy or amplitude of the second band and a mean value of the first spectral envelope is greater than a preset value, where N is a positive integer. The mean value of the first spectral envelope may be a mean value of the N values included in the first spectral envelope. Further, the signal decoding device may separately scale the N values included in the first spectral envelope when a ratio between a square root of the mean value of the energy or amplitude of the second band and the mean value of the first spectral envelope is greater than the preset value. For example, the N values included in the first spectral envelope may be separately multiplied by a scaling ratio value, where the scaling ratio value may be determined according to the mean value of the energy or amplitude of the second band and the mean value of the first spectral envelope. In a case in which the coding mode of the voice or audio signal is the time-domain coding mode, the scaling ratio value is greater than 1; in a case in which the coding mode of the voice or audio signal is the time-frequency joint coding mode or the frequency-domain coding mode, the scaling ratio value is less than 1.

When the preset condition is satisfied, the determining of the spectral envelope of the extension band of the current frame further needs to be based on the spectral envelope of the extension band of the previous frame. Specifically, the foregoing second spectral envelope and the spectral envelope of the extension band of the previous frame may be weighted, to determine the spectral envelope of the extension band of the current frame. In a case in which the preset condition is not satisfied, the band envelope of the extension band of the current frame may be the second spectral envelope.

Optionally, as another embodiment, the signal decoding device may determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a third spectral envelope of the extension band of the current frame; or in a case in which it is determined that a preset condition is not satisfied, use the second spectral envelope of the extension band of the current frame as a third spectral envelope of the extension band of the current frame; and determine a spectral envelope of the extension band of the current frame according to a pitch period of the decoded signal, a voicing factor of the decoded signal and the third spectral envelope of the extension band of the current frame.

Specifically, a process of determining the third spectral envelope of the extension band of the current frame may be similar to the process of determining the spectral envelope of the extension band of the current frame in the foregoing embodiment, and is not described in detail herein again to prevent repetition. That is, in the foregoing embodiment, the third spectral envelope of the extension band of the current frame is used as the spectral envelope of the extension band of the current frame; however, herein, to make the spectral envelope of the extension band more precise, the third spectral envelope of the extension band may be further modified to obtain the spectral envelope of the extension band, that is, the third spectral envelope of the extension band may be modified according to the pitch period and the voicing factor of the foregoing decoded signal (namely, the decoded signal of the current frame), so that the final spectral envelope of the extension band is inversely proportional to the voicing factor and directly proportional to the pitch period, thereby determining the final spectral envelope of the extension band.

For example, the spectral envelope wenv of the extension band may be determined based on the following equation:

$$\text{wenv}=(a1*\text{pitch}*\text{pitch}+b1*\text{pitch}+c1)/(a2*\text{voice_fac}*\text{voice_fac}+b2*\text{voice_fac}+c2)*\text{wenv3}$$

where pitch may represent the pitch period of the decoded signal, voice_fac may represent the voicing factor of the decoded signal, and wenv3 may represent the third spectral envelope of the extension band; a1 and b1 cannot be 0 at the same time, and a2, b2, and c2 cannot be 0 at the same time.

In this way, this embodiment is applicable to a case in which an extension band has bits and a case in which an extension band is a blind band.

Optionally, as another embodiment, the foregoing preset condition may include at least one of the following three conditions: condition 1: a coding mode of a voice signal or an audio signal of the current frame is different from a coding mode of a voice signal or an audio signal of the previous frame; condition 2: a decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers; and condition 3: the decoded signal of the current frame is non-fricative, and a ratio between the second spectral envelope of the extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

Specifically, that a coding mode of a voice signal or an audio signal of the current frame is different from a coding mode of a voice signal or an audio signal of the previous frame may refer to that the coding mode of the voice or audio signal of the current frame is the time-domain coding mode while the coding mode of the voice or audio signal of the previous frame is the time-frequency joint coding mode or the frequency-domain coding mode, or may refer to that the coding mode of the voice or audio signal of the current frame is the time-frequency joint coding mode or the frequency-domain coding mode while the coding mode of the voice or audio signal of the previous frame is the time-domain coding mode.

The decoded signal of the previous frame is non-fricative, and the ratio between the mean value of the energy or amplitude of the $m^{th}$ band in the decoded signal of the current frame and the mean value of the energy or amplitude of the $n^{th}$ band in the decoded signal of the previous frame is within the preset threshold range, where the preset threshold range may be set according to an actual situation and is not limited in this embodiment of the present invention. If the decoded signal of the current frame and the decoded signal of the previous frame are both voice signals and are both voiced sound or unvoiced sound, the preset threshold range may be expanded appropriately.

In addition, in the foregoing condition, the mean value of the energy or amplitude of the $m^{th}$ band in the decoded signal of the current frame may be obtained by selecting the $m^{th}$ band from the decoded signal of the current frame according to a predefined rule or an actual situation and determining the mean value of the energy or amplitude of the band. Moreover, the mean value of the energy or amplitude of the $m^{th}$ band in the decoded signal of the current frame may be stored; in a next frame, the stored mean value of the energy or amplitude of the $m^{th}$ band in the decoded signal of the current frame may be directly acquired. Therefore, the mean value of the energy or amplitude of the $n^{th}$ band in the decoded signal of the previous frame is already stored during the previous frame. In this case, the stored mean value of the energy or amplitude of the $n^{th}$ band in the decoded signal of the previous frame may be directly acquired. If the coding mode of the voice or audio signal of the current frame is different from the coding mode of the voice or audio signal of the previous frame, the $m^{th}$ band in the decoded signal of the current frame may be different from the $n^{th}$ band in the decoded signal of the previous frame.

In addition, for a manner of determining the mean value of the energy or amplitude of the $j^{th}$ band in the decoded signal of the current frame, reference may be made to the foregoing manner of determining the mean value of the energy or amplitude of the $m^{th}$ band. For a manner of determining the mean value of the energy or amplitude of the $k^{th}$ band in the decoded signal of the previous frame, reference may be made to the foregoing manner of determining the mean value of the energy or amplitude of the $n^{th}$ band. To prevent repetition, details are not described herein again.

Specifically, when at least one of the foregoing three conditions is satisfied, the signal decoding device may weight the foregoing second spectral envelope and the spectral envelope of the extension band of the previous frame, to determine the spectral envelope of the extension band of the current frame. When none of the foregoing three conditions is satisfied, the band envelope of the extension band of the current frame may be the second spectral envelope.

140: Determine a frequency-domain signal of the extension band according to the spectral envelope of the extension band and the excitation signal of the extension band.

For example, the frequency-domain signal of the extension band may be determined by multiplying the spectral envelope of the extension band and the excitation signal of the extension band.

In this embodiment of the present invention, the foregoing manner of determining the frequency-domain signal of the extension band may be referred to as a frequency-domain bandwidth extension manner.

Optionally, as another embodiment, in a case in which the coding mode of the voice or audio signal is the time-frequency joint coding mode or the frequency-domain coding mode, the signal decoding device may transform the frequency-domain signal of the extension band into a first time-domain signal of the extension band, and synthesize the decoded signal and the first time-domain signal of the extension band, to acquire an output signal.

Optionally, as another embodiment, in a case in which the coding mode of the voice or audio signal is the time-domain coding mode, the signal decoding device may acquire a second time-domain signal of the extension band in a time-domain bandwidth extension manner. The frequency-domain signal of the extension band may be transformed into a third time-domain signal of the extension band. The second time-domain signal of the extension band and the third time-domain signal of the extension band may be synthesized, to acquire a final time-domain signal of the extension band. The decoded signal may be synthesized with the final time-domain signal of the extension band, to acquire an output signal.

Specifically, in a case in which the coding mode of the voice or audio signal is the time-domain coding mode, the signal decoding device may acquire the final time-domain signal of the extension band in the time-domain bandwidth extension manner and the frequency-domain bandwidth extension manner. Then, the decoded signal may be synthesized with the final time-domain signal of the extension band, to acquire the final output signal. For a specific process of the time-domain bandwidth extension manner, reference may be made to the prior aft; to prevent repetition, details are not described herein again.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

In another embodiment, a signal decoding method according to this embodiment of the present invention includes: decoding a bit stream of a voice signal or an audio signal, to acquire a decoded signal; predicting an excitation signal of an extension band according to the decoded signal, where the extension band is adjacent to a band of the decoded signal, and the band of the decoded signal is lower than the extension band; according to a direction from a start point of the extension band to a low frequency, selecting a first band and a second band from the band of the decoded signal, where the first band is adjacent to the extension band, and the second band is adjacent to the first band; predicting a spectral envelope of the extension band according to a spectral coefficient of the first band and a spectral coefficient of the second band; and determining a frequency-domain signal of the extension band according to the spectral envelope of the extension band and the excitation signal of the extension band.

This embodiment differs from the foregoing embodiment in a manner of selecting the first band and the second band. In this embodiment, the selected first band is adjacent to the extension band, and the second band is adjacent to the first band, where the term "adjacent" herein indicates that two bands are continuous or two bands are not spaced by any frequency bin. Specifically, a signal decoding device may sequentially select, in the direction from the start point of the extension band to the low frequency, the first band and the second band from the band of the decoded signal. For example, assuming that the band of the decoded signal is 0 to 6.4 kHz and the extension band is 6 kHz to 8 kHz, the first band may be 4.8 kHz to 6.4 kHz, and the second band may be 3.2 kHz to 4.8 kHz. Assuming that the band of the decoded signal is 0 to 6.4 kHz and the extension band is 6.4 kHz to 14 kHz, the first band may be 4 kHz to 6.4 kHz, and the second band may be 3.2 kHz to 4 kHz. The foregoing examples of numerical values are used to help a person skilled in the art better understand this embodiment of the present invention, rather than limit the scope of the present invention. The first band and the second band may be selected according to an actual situation, which is not limited in this embodiment of the present invention.

Obviously, specific implementation manners and embodiments related to all other steps except the step of selecting the first band and the second band in the foregoing embodiment are applicable to corresponding steps in this embodiment.

The following describes this embodiment of the present invention in detail with reference to specific examples. It should be noted that these examples are used to help a person skilled in the art better understand this embodiment of the present invention, rather than limit the scope of this embodiment of the present invention.

Figure 2:
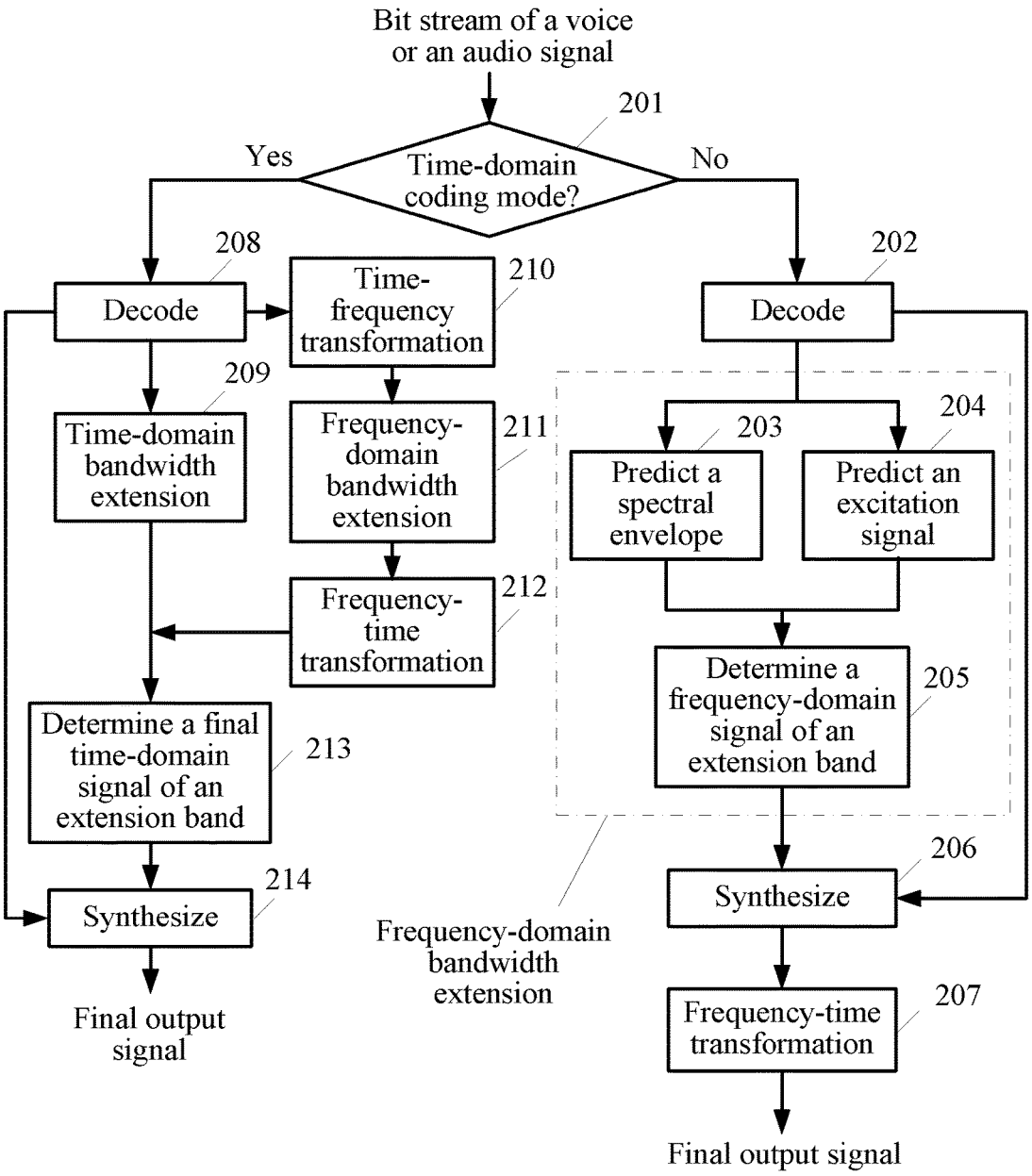
FIG. 2 is a schematic flowchart of a process of a signal decoding method according to an embodiment of the present invention.

FIG. 2 is a schematic flowchart of a process of the signal decoding method according to this embodiment of the present invention.

In FIG. 2, it is assumed that a sampling rate of a voice signal or an audio signal is 12.8 kHz.

201: A signal decoding device determines a coding mode of the voice or audio signal.

202: In a case in which the signal decoding device determines that the coding mode of the voice or audio signal is not a time-domain coding mode, for example, the coding mode of the voice or audio signal is a time-domain joint coding mode or a frequency-domain coding mode, the signal decoding device may use a corresponding decoding mode to decode a bit stream of the voice or audio signal, to acquire a decoded signal. Because the sampling rate of the voice or audio signal is 12.8 kHz, bandwidth of the decoded signal is 6.4 kHz. To acquire an output signal having a bandwidth of 8 kHz, blind bandwidth extension needs to be performed, to restore a signal having a band of 6 kHz to 8 kHz, that is, the signal having the band of 6 kHz to 8 kHz is obtained by means of extension.

In a case in which the coding mode of the voice or audio signal is the time-domain joint coding mode or the frequency-domain coding mode, the signal decoding device may use a frequency-domain bandwidth extension manner to restore a frequency-domain signal having an extension band of 6 kHz to 8 kHz.

203: The signal decoding device selects a first band and a second band from the decoded signal of step 202, and predicts a spectral envelope of an extension band according to a spectral coefficient of the first band and a spectral coefficient of the second band.

Optionally, the signal decoding device may select the first band and the second band from the decoded signal according to a direction from a start point of the extension band to a low frequency, where the first band is adjacent to the extension band, and the first band is adjacent to the second band. The following describes a process of predicting the spectral envelope of the extension band in detail with reference to a specific example. It should be noted that this example is merely used to help a person skilled in the aft better understand this embodiment of the present invention, rather than limit the scope of this embodiment of the present invention.

In the following example, it is assumed that the extension band is divided into two subbands; in this case, a spectral envelope value of each subband needs to be predicted, where wenv[1] and wenv[2] are used herein to represent spectral envelope values of the two subbands.

(1) The first band may be selected from the band of the decoded signal; assuming that the first band is 4.8 kHz to 6.4 kHz, the first band may be divided into two subbands, where the first subband is 4.8 kHz to 5.6 kHz, and the second subband is 5.6 kHz to 6.4 kHz. The signal decoding device may determine a mean value ener1 of energy of the first subband according to a spectral coefficient of the first subband, and may determine a mean value ener2 of energy of the second subband according to a spectral coefficient of the second subband.

Assuming that a preset threshold range is (0.5, 2), if ener1/ener2>2, ener1 may be scaled, for example, ener1'=ener1*(2*ener2/ener1), and ener2 may remain unchanged, that is, ener2'=ener2. Herein, ener1' may represent an adjusted value of the energy of the first subband, and ener2' may represent an adjusted value of the energy of the second subband.

If ener1/ener2<0.5, ener2 may be scaled, for example, ener2'=ener2*(2*ener1/ener2), and ener1 may remain unchanged, that is, ener1'=ener1.

It should be noted that, although the adjusted value of the energy of the first subband and the adjusted value of the energy of the second subband are determined according to whether a ratio between the mean value of the energy of the first subband and the mean value of the energy of the second subband is within the threshold range herein, in this embodiment of the present invention, the adjusted value of the energy of the first subband and the adjusted value of the energy of the second subband may also be determined according to whether a variance of the mean value of the energy of the first subband and the mean value of the energy of the second subband is within a threshold range; for a determining process, reference may be made to the foregoing ratio-based determining process, and details are not described herein again.

Therefore, a first spectral envelope of the extension band is determined according to ener1' and ener2', where the first spectral envelope is a preliminary prediction on the spectral envelope of the extension band, and the first spectral envelope includes two spectral envelope values, namely, wenv[1]' and wenv[2]+.

For example, wenv[1]' and wenv[2]' may be determined in the following manner:

$$wenv[1]'=\sqrt{ener1'},\ wenv[2]'=\sqrt{ener2'}.$$

Alternatively, wenv[1]' and wenv[2]' may be determined in the following manner:

$$wenv[1]'=wenv[2]'=\sqrt{(ener1'+ener2')/2}.$$

(2) The second band may be selected from the band of the decoded signal, and it is assumed that the second band is 3.2 kHz to 4.8 kHz. The signal decoding device may determine a mean value enerL of energy of the second band according to the spectral coefficient of the second band.

The signal decoding device may determine a second spectral envelope of the extension band according to enerL as well as wenv[1]' and wenv[2]', where the second spectral envelope includes two spectral envelope values, namely, wenv[1]" and wenv[2]".

For example, if $\sqrt{enerL}>k*[(wenv[1]'+wenv[2]')/2]$, where a value of k may be defined in advance, wenv[1]' and wenv[2]' may be scaled, so as to determine two spectral envelope values, namely, wenv[1] and wenv[2], of the extension band.

For example, according to enerL as well as wenv[1]' and wenv[2]', wenv[1]" and wenv[2]" may be determined in the following manner:

In a case in which the coding mode of the voice or audio signal is the time-domain coding mode:

$$wenv[1]''=p*wenv[1]',\ wenv[2]''=p*wenv[2]',\ p=\sqrt{enerL}/[(wenv[1]'+wenv[2]')/2].$$

In a case in which the coding mode of the voice or audio signal is the time-frequency joint coding mode or the frequency-domain coding mode:

$$wenv[1]''=p*wenv[1]',\ wenv[2]''=p*wenv[2]',\ p=[(wenv[1]'+wenv[2]')/2]/\sqrt{enerL}.$$

In addition, if the decoded signal is fricative, wenv[1]" and wenv[2]" obtained above are further scaled, where a scaling ratio value is less than 1.

It should be noted that, the foregoing process of predicting wenv[1]" and wenv[2]" may also be as follows:

In step (1) described above, the signal decoding device may also determine a mean value amp1 of amplitude of the first subband according to a spectral coefficient of the first subband, and may determine a mean value amp2 of amplitude of the second subband according to a spectral coefficient of the second subband.

Assuming that a preset threshold range is (0.5, 2), if amp1/amp2>2, amp1 may be scaled, for example, amp1'=amp1*(2*amp2/amp1), and amp2 may remain unchanged, that is, amp2'=amp2. Herein, amp1' may represent an adjusted value of the amplitude of the first subband, and amp2' may represent an adjusted value of the amplitude of the second subband.

If amp1/amp2<0.5, amp2 may be scaled, for example, amp2'=amp2*(2*amp1/amp2), and amp1 may remain unchanged, that is, amp1'=amp1.

It should be noted that, although the adjusted value of the amplitude of the first subband and the adjusted value of the amplitude of the second subband are determined according to whether a ratio between the mean value of the amplitude of the first subband and the mean value of the amplitude of the second subband is within the threshold range herein, in this embodiment of the present invention, the adjusted value of the amplitude of the first subband and the adjusted value of the amplitude of the second subband may also be determined according to whether a variance of the mean value of the amplitude of the first subband and the mean value of the amplitude of the second subband is within a threshold range;

for a determining process, reference may be made to the foregoing ratio-based determining process, and details are not described herein again.

Therefore, a first spectral envelope of the extension band is determined according to amp1' and amp2', where the first spectral envelope is a preliminary prediction on the spectral envelope of the extension band, and the first spectral envelope includes two spectral envelope values, namely, wenv[1]' and wenv[2]'.

For example, wenv[1]' and wenv[2]' may be determined in the following manner:

$$wenv[1]'=amp1',\ wenv[2]'=amp2'.$$

Alternatively, wenv[1]' and wenv[2]' may be determined in the following manner:

$$wenv[1]'=wenv[2]'=(amp1'+amp2')/2.$$

In step (2) described above, the signal decoding device may also determine a mean value ampL of amplitude of the second band according to the spectral coefficient of the second band.

The signal decoding device may determine wenv[1]" and wenv[2]" according to apmL as well as wenv[1]' and wenv[2]'.

For example, if mpL>k*[wenv[1]'+wenv[2]')/2], where a value of k may be defined in advance, wenv[1]' and wenv[2]' may be scaled, so as to determine two spectral envelope values, namely, wenv[1] and wenv[2], of the extension band.

For example, according to ampL as well as wenv[1]' and wenv[2]', wenv[1]" and wenv[2]" may be determined in the following manner:

In a case in which the coding mode of the voice or audio signal is the time-domain coding mode:

$$wenv[1]''=p*wenv[1]',\ wenv[2]''=p*wenv[2]',$$
$$p=ampL/[(wenv[1]'+wenv[2]')/2].$$

In a case in which the coding mode of the voice or audio signal is the time-frequency joint coding mode or the frequency-domain coding mode:

$$wenv[1]''=p*wenv[1]',\ wenv[2]''=p*wenv[2]',$$
$$p=[(wenv[1]'+wenv[2]')/2]/ampL.$$

(3) The signal decoding device may determine whether a preset condition is satisfied. In a case in which it is determined that the preset condition is satisfied, the foregoing wenv[1]" and wenv[2]" are weighted with a spectral envelope of an extension band of a previous frame, to determine wenv[1] and wenv[2].

In a case in which it is determined that the preset condition is not satisfied, wenv[1]=wenv[1]", and wenv[2]=wenv[2]".

The preset condition may include at least one of the following:

(a): A coding mode of a voice signal or an audio signal of a current frame is different from a coding mode of a voice signal or an audio signal of a previous frame.

For example, the coding mode of the voice or audio signal herein is the time-frequency joint coding mode or the frequency-domain coding mode, but the coding mode of the voice or audio signal of the previous frame may be the time-domain coding mode.

(b) A decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers.

For example, the preset threshold range may be set according to an actual situation. For example, the preset threshold range may be (0.5, 2). If the decoded signal of the current frame and the decoded signal of the previous frame are both voice signals and are both voiced sound or unvoiced sound, the preset threshold range may be expanded appropriately. For example, the preset threshold range may be expanded to be (0.4, 2.5).

In addition, in this condition, the mean value of the energy or amplitude of the $m^{th}$ band in the decoded signal of the current frame may be obtained by selecting the $m^{th}$ band from the decoded signal of the current frame according to a predefined rule or an actual situation and determining the mean value of the energy or amplitude of the band. Moreover, the mean value of the energy or amplitude of the $m^{th}$ band in the decoded signal of the current frame may be stored; in a next frame, the stored mean value of the energy or amplitude of the $m^{th}$ band in the decoded signal of the current frame may be directly acquired. Therefore, the mean value of the energy or amplitude of the $n^{th}$ band in the decoded signal of the previous frame is already stored during the previous frame. In this case, the stored mean value of the energy or amplitude of the $n^{th}$ band in the decoded signal of the previous frame may be directly acquired. If the coding mode of the voice or audio signal of the current frame is different from the coding mode of the voice or audio signal of the previous frame, the $m^{th}$ band in the decoded signal of the current frame may be different from the $n^{th}$ band in the decoded signal of the previous frame. For example, if the coding mode of the voice or audio signal of the current frame is the time-frequency joint coding mode or the frequency-domain coding mode, a band of 2 kHz to 6 kHz may be selected from the decoded signal of the current frame, and a mean value of energy or amplitude of the band is determined. If the coding mode of the voice or audio signal of the previous frame is the time-domain coding mode, a mean value of energy or amplitude of a band of 4 kHz to 6 kHz in the decoded signal of the previous frame may be determined.

(c) The decoded signal of the current frame is non-fricative, and a ratio between a second spectral envelope of an extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

In this condition, for a manner of determining the mean value of the energy or amplitude of the $j^{th}$ band in the decoded signal of the current frame, reference may be made to the manner of determining the mean value of the energy or amplitude of the $m^{th}$ band in the condition (b). For a manner of determining the mean value of the energy or amplitude of the $k^{th}$ band in the decoded signal of the previous frame, reference may be made to the manner of determining the mean value of the energy or amplitude of the $n^{th}$ band in the condition (b). If the coding mode of the voice or audio signal of the current frame is different from the coding mode of the voice or audio signal of the previous frame, the $j^{th}$ band and the $k^{th}$ band may be different.

204: The signal decoding device predicts an excitation signal of the extension band according to a spectral coefficient of the decoded signal obtained in step 202.

For example, the coding mode of the voice or audio signal herein is the time-frequency joint coding mode or the frequency-domain coding mode, and the signal decoding device may select, from the band of the decoded signal, a band that is restored well and a quantity of bits allocated to which is greater than a preset bit quantity threshold, and predict the excitation signal of the extension band according to a spectral coefficient of the band. For example, an excitation signal of an extension band of 6 kHz to 8 kHz may be predicted according to a spectral coefficient of a band of 2 kHz to 4 kHz.

In addition, if the coding mode of the voice or audio signal is the time-domain coding mode, the signal decoding device may select, from the band of the decoded signal, a band that is adjacent to the extension band, and predict the excitation signal of the extension band according to a spectral coefficient of the selected band. For example, the excitation signal of the extension band of 6 kHz to 8 kHz may be predicted according to a spectral coefficient of a band of 4 kHz to 6 kHz.

205: The signal decoding device may determine a frequency-domain signal of the extension band according to the spectral envelope predicted in step 203 and the excitation signal predicted in step 204.

For example, the frequency-domain signal of the extension band may be determined by multiplying the spectral envelope of the extension band and the excitation signal of the extension band.

206: The signal decoding device synthesizes the decoded signal obtained in step 202 and the frequency-domain signal of the extension band obtained in step 205, to acquire a frequency-domain output signal.

207: The signal decoding device performs frequency-time transformation on the frequency-domain output signal obtained in step 206, to acquire a final output signal.

208: In a case in which the signal decoding device determines that the coding mode of the voice or audio signal is a time-domain coding mode, the signal decoding device uses a corresponding decoding mode to decode a bit stream of the voice or audio signal.

Because the sampling rate of the voice or audio signal is 12.8 kHz, bandwidth of a decoded signal is 6.4 kHz. To acquire an output signal having a bandwidth of 8 kHz, blind bandwidth extension needs to be performed, to restore a signal having a band of 6 kHz to 8 kHz, that is, the extension band is 6 kHz to 8 kHz.

In a case in which the coding mode of the voice or audio signal is the time-domain coding mode, the signal decoding device may use a time-domain bandwidth extension manner and a frequency-domain bandwidth extension manner to restore a final time-domain signal of the extension band of 6 kHz to 8 kHz.

209: The signal decoding device uses a time-domain bandwidth extension manner to determine a first time-domain signal of an extension band of 6 kHz to 8 kHz according to a decoded signal in step 208.

For a specific process of the time-domain bandwidth extension manner, reference may be made to the prior aft; to prevent repetition, details are not described herein again.

210: The signal decoding device performs time-frequency transformation on the decoded signal in step 208, to transform the decoded signal from a time-domain signal into a frequency-domain signal.

211: The signal decoding device uses a frequency-domain bandwidth extension manner to determine a frequency-domain signal of the extension band.

For a specific process, reference may be made to step 203 to step 205; to prevent repetition, details are not described herein again.

212: The signal decoding device performs frequency-time transformation on the frequency-domain signal of the extension band determined in step 211, to determine a second time-domain signal of the extension band.

213: The signal decoding device adds up the first time-domain signal of the extension band and the second time-domain signal of the extension band, to determine a final time-domain signal of the extension band.

214: The signal decoding device synthesizes the decoded signal obtained in step 208 and the frequency-domain signal of the extension band obtained in step 213, to determine a final output signal.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

Figure 3:
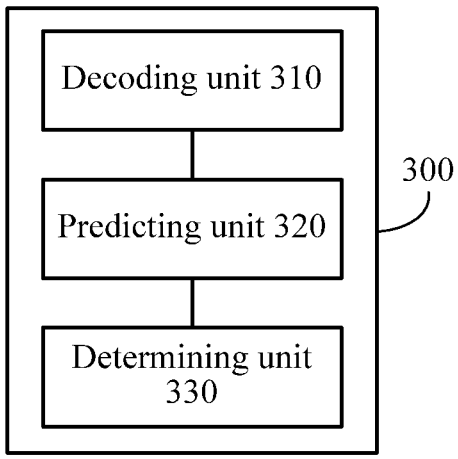
FIG. 3 is a schematic block diagram of a signal decoding device according to an embodiment of the present invention.

FIG. 3 is a schematic block diagram of a signal decoding device according to an embodiment of the present invention. An example of a device 300 in FIG. 3 is a decoder. The device 300 includes a decoding unit 310, a predicting unit 320, and a determining unit 330.

The decoding unit 310 decodes a bit stream of a voice signal or an audio signal, to acquire a decoded signal. The predicting unit 320 receives the decoded signal from the decoding unit 310, and predicts an excitation signal of an extension band according to the decoded signal, where the extension band is adjacent to a band of the decoded signal, and the band of the decoded signal is lower than the extension band. The predicting unit 320 further selects a first band and a second band from the decoded signal, and predicts a spectral envelope of the extension band according to a spectral coefficient of the first band and a spectral coefficient of the second band, where a distance from a highest frequency bin of the first band to a lowest frequency bin of the extension band is less than or equal to a first value, and a distance from a highest frequency bin of the second band to a lowest frequency bin of the first band is less than or equal to a second value. The determining unit 330 receives, from the predicting unit 320, the spectral envelope of the extension band and the excitation signal of the extension band, and determines a frequency-domain signal of the extension band according to the spectral envelope of the extension band and the excitation signal of the extension band.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

For other functions and operations of the device 300, reference may be made to the processes of the method embodiments in FIG. 1 and FIG. 2; to prevent repetition, details are not described herein again.

Optionally, as an embodiment, the predicting unit 320 may select the first band and the second band from the decoded signal according to a direction from a start point of the extension band to a low frequency, where the distance from the highest frequency bin of the first band to the lowest frequency bin of the extension band is equal to the first value, and the first value is 0; and the distance from the highest frequency bin of the second band to the lowest frequency bin of the first band is equal to the second value, and the second value is 0.

Optionally, as another embodiment, the predicting unit 320 may divide the first band into M subbands, and determine a mean value of energy or amplitude of each subband according to the spectral coefficient of the first band, where M is a positive integer; determine an adjusted value of the energy or amplitude of each subband according to the mean value of the energy or amplitude of each subband; predict a first spectral envelope of the extension band according to the adjusted value of the energy or amplitude of each subband; determine a mean value of energy or amplitude of the second band according to the spectral coefficient of the second band; and predict the spectral envelope of the extension band according to the first spectral envelope of the extension band and the mean value of the energy or amplitude of the second band.

Optionally, as another embodiment, if a variance of mean values of energy or amplitude of the M subbands is not within a preset threshold range, the predicting unit 320 may adjust a mean value of energy or amplitude of each subband in a subbands to determine an adjusted value of the energy or amplitude of each subband in the a subbands, and use a mean value of energy or amplitude of each subband in b subbands as an adjusted value of the energy or amplitude of each subband in the b subbands, where the mean value of the energy or amplitude of each subband in the a subbands is greater than or equal to a mean value threshold, the mean value of the energy or amplitude of each subband in the b subbands is less than the mean value threshold, a and b are positive integers, and a+b=M.

If a variance of mean values of energy or amplitude of the M subbands is within a preset threshold range, the predicting unit 320 may use the mean value of the energy or amplitude of each subband as the adjusted value of the energy or amplitude of each subband.

Optionally, as another embodiment, for the $i^{th}$ subband and the $(i+1)^{th}$ subband in the M subbands, if a ratio between a mean value of energy or amplitude of the $i^{th}$ subband and a mean value of energy or amplitude of the $(i+1)^{th}$ subband is not within a preset threshold range, when the mean value of the energy or amplitude of the $i^{th}$ subband is greater than the mean value of the energy or amplitude of the $(i+1)^{th}$ subband, the predicting unit 320 may adjust the mean value of the energy or amplitude of the $i^{th}$ subband to determine an adjusted value of the energy or amplitude of the $i^{th}$ subband, and use the mean value of the energy or amplitude of the $(i+1)^{th}$ subband as an adjusted value of the energy or amplitude of the $(i+1)^{th}$ subband; or when the mean value of the energy or amplitude of the $i^{th}$ subband is less than the mean value of the energy or amplitude of the $(i+1)^{th}$ subband, the predicting unit 320 may adjust the mean value of the energy or amplitude of the $(i+1)^{th}$ subband to determine an adjusted value of the energy or amplitude of the $(i+1)^{th}$ subband, and use the mean value of the energy or amplitude of the $i^{th}$ subband as an adjusted value of the energy or amplitude of the $i^{th}$ subband.

If a ratio between a mean value of energy or amplitude of the $i^{th}$ subband and a mean value of energy or amplitude of the $(i+1)^{th}$ subband is within a preset threshold range, the predicting unit 320 may use the mean value of the energy or amplitude of the $i^{th}$ subband as an adjusted value of the energy or amplitude of the $i^{th}$ subband, and use the mean value of the energy or amplitude of the $(i+1)^{th}$ subband as an adjusted value of the $(i+1)^{th}$ subband, where i is a positive integer, and $1 \le i \le M-1$.

Optionally, as another embodiment, the predicting unit 320 may determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a spectral envelope of the extension band of the current frame; or in a case in which it is determined that a preset condition is not satisfied, use the second spectral envelope of the extension band of the current frame as a spectral envelope of the extension band of the current frame.

Optionally, as another embodiment, the predicting unit 320 may determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a third spectral envelope of the extension band of the current frame; or in a case in which it is determined that a preset condition is not satisfied, use the second spectral envelope of the extension band of the current frame as a third spectral envelope of the extension band of the current frame; and determine a spectral envelope of the extension band of the current frame according to a pitch period of the decoded signal, a voicing factor of the decoded signal and the third spectral envelope of the extension band of the current frame.

Optionally, as another embodiment, the foregoing preset condition may include at least one of the following three conditions: condition 1: a coding mode of a voice signal or an audio signal of the current frame is different from a coding mode of a voice signal or an audio signal of the previous frame; condition 2: a decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers; and condition 3: the decoded signal of the current frame is non-fricative, and a ratio between the second spectral envelope of the extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

Optionally, as another embodiment, in a case in which the coding mode of the voice or audio signal is a time-domain coding mode, the predicting unit 320 may select a third band from the decoded signal, where the third band is adjacent to the extension band; and predict the excitation signal of the extension band according to a spectral coefficient of the third band.

Optionally, as another embodiment, in a case in which the coding mode of the voice or audio signal is a time-frequency joint coding mode or a frequency-domain coding mode, the predicting unit 320 may select a fourth band from the decoded signal, where a quantity of bits allocated to the fourth band is greater than a preset bit quantity threshold;

and predict the excitation signal of the extension band according to a spectral coefficient of the fourth band.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

Figure 4:
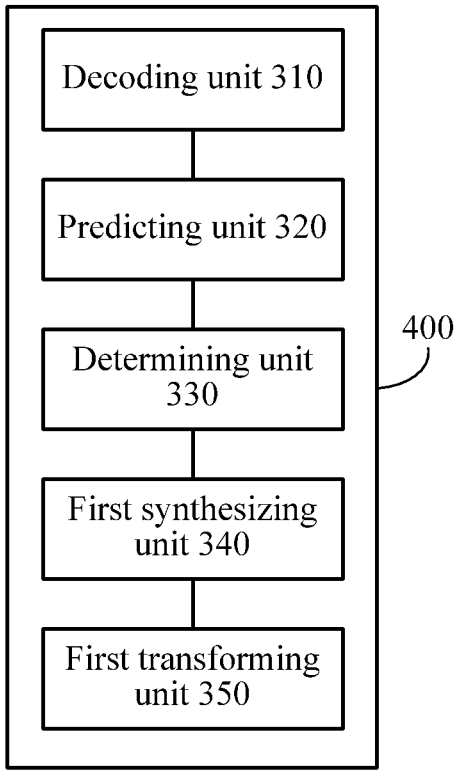
FIG. 4 is a schematic block diagram of a signal decoding device according to another embodiment of the present invention.

FIG. 4 is a schematic block diagram of a signal decoding device according to another embodiment of the present invention. An example of a device 400 in FIG. 4 is a decoder. In FIG. 4, parts that are the same as or similar to those in FIG. 3 use reference numerals the same as those in FIG. 3. In addition to a decoding unit 310, a predicting unit 320, and a determining unit 330, the device 400 further includes a first synthesizing unit 340 and a first transforming unit 350.

In a case in which a coding mode of a voice or audio signal is a time-frequency joint coding mode or a frequency-domain coding mode, the first synthesizing unit 340 may synthesize a decoded signal and a frequency-domain signal of an extension band, to acquire a frequency-domain output signal. The first transforming 350 may perform frequency-time transformation on the frequency-domain output signal, to acquire a final output signal.

For other functions and operations of the device 400, reference may be made to the processes of the method embodiments in FIG. 1 and FIG. 2; to prevent repetition, details are not described herein again.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

Figure 5:
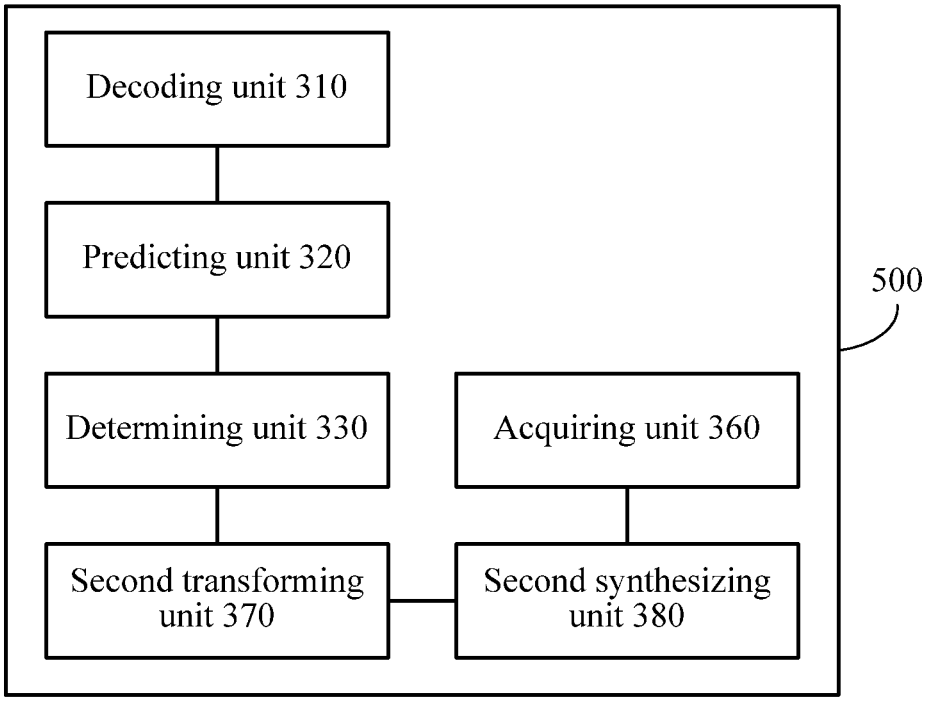
FIG. 5 is a schematic block diagram of a signal decoding device according to another embodiment of the present invention.

FIG. 5 is a schematic block diagram of a signal decoding device according to another embodiment of the present invention. An example of a device 500 in FIG. 5 is a decoder. In FIG. 5, parts that are the same as or similar to those in FIG. 3 and FIG. 4 use reference numerals the same as those in FIG. 3 and FIG. 4. In addition to a decoding unit 310, a predicting unit 320, and a determining unit 330, the device 500 further includes an acquiring unit 360, a second transforming unit 370, and a second synthesizing unit 380.

In a case in which a coding mode of a voice or audio signal is a time-domain coding mode, the acquiring unit 360 may acquire a first time-domain signal of an extension band in a time-domain bandwidth extension manner. The second transforming unit 370 may transform a frequency-domain signal of the extension band into a second time-domain signal of the extension band. The second synthesizing unit 380 may synthesize the first time-domain signal of the extension band and the second time-domain signal of the extension band, to acquire a final time-domain signal of the extension band. The second synthesizing unit 380 may further synthesize a decoded signal and the final time-domain signal of the extension band, to acquire a final output signal.

For other functions and operations of the device 500, reference may be made to the processes of the method embodiments in FIG. 1 and FIG. 2; to prevent repetition, details are not described herein again.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

Figure 6:
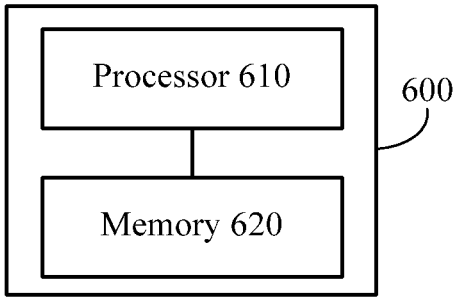
FIG. 6 is a schematic block diagram of a signal decoding device according to an embodiment of the present invention.

FIG. 6 is a schematic block diagram of a signal decoding device according to an embodiment of the present invention. An example of a device 600 in FIG. 6 is a decoder. The device 600 includes a processor 610 and a memory 620.

The memory 620 may include a random access memory, a flash memory, a read-only memory, a programmable read-only memory, a non-volatile memory, a register, or the like. The processor 610 may be a central processing unit (Central Processing Unit, CPU).

The memory 620 is configured to store an executable instruction. The processor 610 may execute the executable instruction stored in the memory 620, and configured to: decode a bit stream of a voice signal or an audio signal, to acquire a decoded signal; predict an excitation signal of an extension band according to the decoded signal, where the extension band is adjacent to a band of the decoded signal, and the band of the decoded signal is lower than the extension band; select a first band and a second band from the decoded signal, and predict a spectral envelope of the extension band according to a spectral coefficient of the first band and a spectral coefficient of the second band, where a distance from a highest frequency bin of the first band to a lowest frequency bin of the extension band is less than or equal to a first value, and a distance from a highest frequency bin of the second band to a lowest frequency bin of the first band is less than or equal to a second value; and determine a frequency-domain signal of the extension band according to the spectral envelope of the extension band and the excitation signal of the extension band.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

For other functions and operations of the device 600, reference may be made to the processes of the method embodiments in FIG. 1 and FIG. 2; to prevent repetition, details are not described herein again.

Optionally, as an embodiment, the processor 610 may select the first band and the second band from the decoded signal according to a direction from a start point of the extension band to a low frequency, where the distance from the highest frequency bin of the first band to the lowest frequency bin of the extension band is equal to the first value, and the first value is 0; and the distance from the highest frequency bin of the second band to the lowest frequency bin of the first band is equal to the second value, and the second value is 0.

Optionally, as another embodiment, the processor 610 may divide the first band into M subbands, and determine a mean value of energy or amplitude of each subband according to the spectral coefficient of the first band, where M is a positive integer; determine an adjusted value of the energy or amplitude of each subband according to the mean value of the energy or amplitude of each subband; predict a first spectral envelope of the extension band according to the adjusted value of the energy or amplitude of each subband; determine a mean value of energy or amplitude of the second band according to the spectral coefficient of the second band; and predict the spectral envelope of the extension band according to the first spectral envelope of the extension band and the mean value of the energy or amplitude of the second band.

Optionally, as another embodiment, if a variance of mean values of energy or amplitude of the M subbands is not within a preset threshold range, the processor 610 may adjust a mean value of energy or amplitude of each subband in a subbands to determine an adjusted value of the energy or amplitude of each subband in the a subbands, and use a mean value of energy or amplitude of each subband in b subbands as an adjusted value of the energy or amplitude of each subband in the b subbands, where the mean value of the energy or amplitude of each subband in the a subbands is greater than or equal to a mean value threshold, the mean value of the energy or amplitude of each subband in the b subbands is less than the mean value threshold, a and b are positive integers, and a+b=M.

If a variance of mean values of energy or amplitude of the M subbands is within a preset threshold range, the processor 610 may use the mean value of the energy or amplitude of each subband as the adjusted value of the energy or amplitude of each subband.

Optionally, as another embodiment, for the $i^{th}$ subband and the $(i+1)^{th}$ subband in the M subbands, if a ratio between a mean value of energy or amplitude of the $i^{th}$ subband and a mean value of energy or amplitude of the $(i+1)^{th}$ subband is not within a preset threshold range, when the mean value of the energy or amplitude of the $i^{th}$ subband is greater than the mean value of the energy or amplitude of the $(i+1)^{th}$ subband, the processor 610 may adjust the mean value of the energy or amplitude of the $i^{th}$ subband to determine an adjusted value of the energy or amplitude of the $i^{th}$ subband, and use the mean value of the energy or amplitude of the $(i+1)^{th}$ subband as an adjusted value of the energy or amplitude of the $(i+1)^{th}$ subband; or when the mean value of the energy or amplitude of the $i^{th}$ subband is less than the mean value of the energy or amplitude of the $(i+1)^{th}$ subband, the processor 610 may adjust the mean value of the energy or amplitude of the $(i+1)^{th}$ subband to determine an adjusted value of the energy or amplitude of the $(i+1)^{th}$ subband, and use the mean value of the energy or amplitude of the $i^{th}$ subband as an adjusted value of the energy or amplitude of the $i^{th}$ subband.

If a ratio between a mean value of energy or amplitude of the $i^{th}$ subband and a mean value of energy or amplitude of the $(i+1)^{th}$ subband is within a preset threshold range, the processor 610 may use the mean value of the energy or amplitude of the $i^{th}$ subband as an adjusted value of the energy or amplitude of the $i^{th}$ subband, and use the mean value of the energy or amplitude of the $(i+1)^{th}$ subband as an adjusted value of the $(i+1)^{th}$ subband, where i is a positive integer, and $1 \le i \le M-1$.

Optionally, as another embodiment, the processor 610 may determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a spectral envelope of the extension band of the current frame; or in a case in which it is determined that a preset condition is not satisfied, use the second spectral envelope of the extension band of the current frame as a spectral envelope of the extension band of the current frame.

Optionally, as another embodiment, the processor 610 may determine a second spectral envelope of an extension band of a current frame according to a first spectral envelope of the extension band of the current frame and a mean value of energy or amplitude of a second band of the current frame; in a case in which it is determined that a preset condition is satisfied, weight the second spectral envelope of the extension band of the current frame and a spectral envelope of an extension band of a previous frame, to determine a third spectral envelope of the extension band of the current frame; or in a case in which it is determined that a preset condition is not satisfied, use the second spectral envelope of the extension band of the current frame as a third spectral envelope of the extension band of the current frame; and determine a spectral envelope of the extension band of the current frame according to a pitch period of the decoded signal, a voicing factor of the decoded signal and the third spectral envelope of the extension band of the current frame.

Optionally, as another embodiment, the foregoing preset condition may include at least one of the following three conditions: condition 1: a coding mode of a voice signal or an audio signal of the current frame is different from a coding mode of a voice signal or an audio signal of the previous frame; condition 2: a decoded signal of the previous frame is non-fricative, and a ratio between a mean value of energy or amplitude of the $m^{th}$ band in a decoded signal of the current frame and a mean value of energy or amplitude of the $n^{th}$ band in the decoded signal of the previous frame is within a preset threshold range, where m and n are positive integers; and condition 3: the decoded signal of the current frame is non-fricative, and a ratio between the second spectral envelope of the extension band of the current frame and the spectral envelope of the extension band of the previous frame is greater than a ratio between a mean value of energy or amplitude of the $j^{th}$ band in the decoded signal of the current frame and a mean value of energy or amplitude of the $k^{th}$ band in the decoded signal of the previous frame, where j and k are positive integers.

Optionally, as another embodiment, in a case in which the coding mode of the voice or audio signal is a time-domain coding mode, the processor 610 may select a third band from the decoded signal, where the third band is adjacent to the extension band; and predict the excitation signal of the extension band according to a spectral coefficient of the third band.

Optionally, as another embodiment, in a case in which the coding mode of the voice or audio signal is a time-frequency joint coding mode or a frequency-domain coding mode, the processor 610 may select a fourth band from the decoded signal, where a quantity of bits allocated to the fourth band is greater than a preset bit quantity threshold; and predict the excitation signal of the extension band according to a spectral coefficient of the fourth band.

Optionally, as another embodiment, in a case in which the coding mode of the voice or audio signal is the time-frequency joint coding mode or the frequency-domain coding mode, the processor 610 may further synthesize the decoded signal and the frequency-domain signal of the extension band, to acquire a frequency-domain output signal; and perform frequency-time transformation on the frequency-domain output signal, to acquire a final output signal.

Optionally, as another embodiment, in a case in which the coding mode of the voice or audio signal is the time-domain coding mode, the processor 610 may further acquire a first time-domain signal of the extension band in a time-domain bandwidth extension manner; transform the frequency-domain signal of the extension band into a second time-domain signal of the extension band; synthesize the first time-domain signal of the extension band and the second time-domain signal of the extension band, to acquire a final time-domain signal of the extension band; and synthesize the decoded signal and the final time-domain signal of the extension band, to acquire a final output signal.

The memory 620 may store data information generated during execution of the processor 610. The processor 610 may read the data information from the memory 620.

In this embodiment of the present invention, a spectral envelope and an excitation signal of an extension band are separately predicted according to a decoded signal obtained from a bit stream of a voice signal or an audio signal, so that a frequency-domain signal of the extension band of the voice or audio signal can be determined, and therefore performance of the voice or audio signal can be improved.

Figure 7:
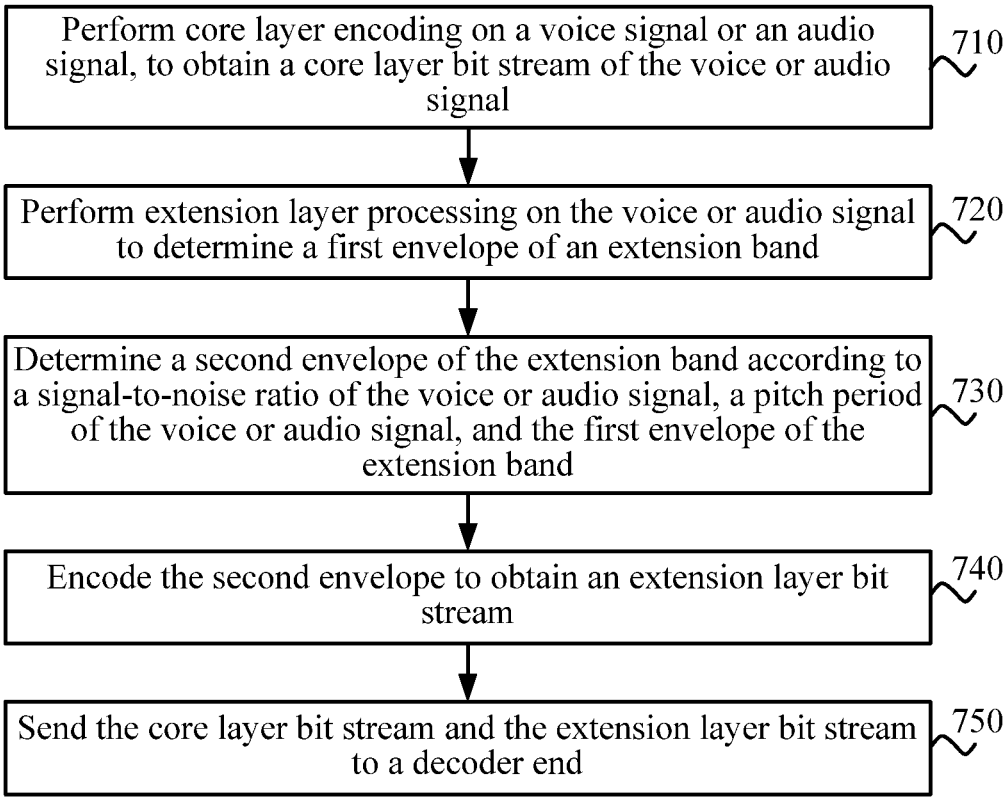
FIG. 7 is a schematic flowchart of a signal encoding method according to an embodiment of the present invention.

FIG. 7 is a schematic flowchart of a signal encoding method according to an embodiment of the present invention. The method in FIG. 7 is executed by an encoder end, for example, a signal encoding device. The signal encoding device divides an input signal into two parts, that is, a low-band signal and an extension band signal, where a core layer processes the low-band signal, and an extension layer processes the extension band signal. The signal encoding method includes:

710: Perform core layer encoding on a voice signal or an audio signal, to obtain a core layer bit stream of the voice or audio signal.

720: Perform extension layer processing on the voice or audio signal to determine a first envelope of an extension band.

The first envelope of the extension band may be an original envelope of the extension band. The first envelope herein may be a frequency-domain envelope or may be a time-domain envelope.

730: Determine a second envelope of the extension band according to a signal-to-noise ratio of the voice or audio signal, a pitch period of the voice or audio signal, and the first envelope of the extension band.

Specifically, the encoder end may further modify the first envelope of the extension band according to the signal-to-noise ratio of the voice or audio signal and the pitch period of the voice or audio signal, so that the second envelope of the extension band is inversely proportional to the signal-to-noise ratio and directly proportional to the pitch period, thereby determining the second envelope of the extension band. For example, the encoder end may determine the second envelope wenv2 of the extension band according to the following equation:

$$\text{wen2}=(a1*\text{pitch}*\text{pitch}+b1*\text{pitch}+c1)/(a2*\text{snr}*\text{snr}+b2*\text{snr}+c2)*\text{wenv1},$$

where wenv1 may represent the first envelope of the extension band, pitch may represent the pitch period of the voice or audio signal, snr may represent the signal-to-noise ratio of the voice or audio signal, a1 and b1 cannot be 0 at the same time, and a2, b2, and C2 cannot be 0 at the same time.

740: Encode the second envelope to obtain an extension layer bit stream.

That is, a quantization index of the second envelope is written into the extension layer bit stream. In addition, the extension layer bit stream may further include a quantization index of another related parameter.

750: Send the core layer bit stream and the extension layer bit stream to a decoder end.

This embodiment of the present invention is applicable to a situation in which an extension band has bits.

In this embodiment of the present invention, a first envelope of an extension band is determined, and a second envelope of the extension band is determined according to a signal-to-noise ratio of a voice or audio signal, a pitch period of the voice or audio signal, and the first envelope of the extension band, so that a decoder end can determine a signal of the extension band according to a core layer bit stream and the second envelope of the extension band, thereby improving performance of the voice or audio signal.

Figure 8:
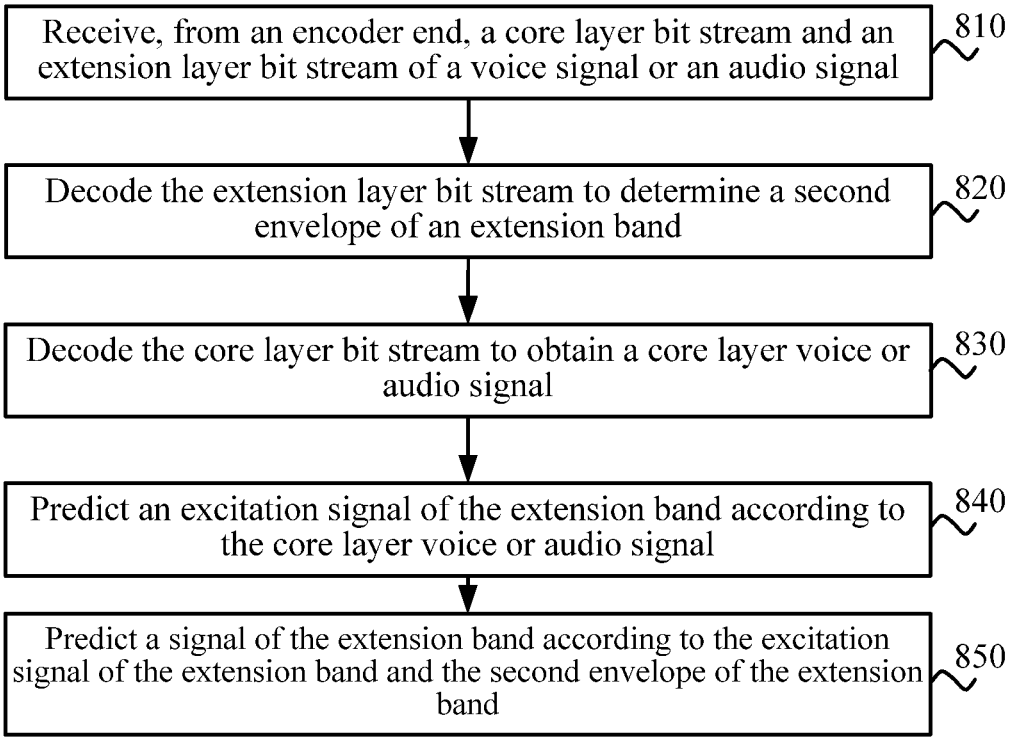
FIG. 8 is a schematic flowchart of a signal decoding method according to an embodiment of the present invention.

FIG. 8 is a schematic flowchart of a signal decoding method according to an embodiment of the present invention. The method in FIG. 8 is executed by a decoder end, for example, a signal decoding device.

810: Receive, from an encoder end, a core layer bit stream and an extension layer bit stream of a voice signal or an audio signal.

820: Decode the extension layer bit stream to determine a second envelope of an extension band, where the second envelope is determined by the encoder end according to a signal-to-noise ratio of the voice or audio signal, a pitch period of the voice or audio signal, and a first envelope of the extension band.

The first envelope of the extension band may be an original envelope of the extension band. The first envelope may be a time-domain envelope or may be a frequency-domain envelope.

830: Decode the core layer bit stream to obtain a core layer voice or audio signal.

840: Predict an excitation signal of the extension band according to the core layer voice or audio signal.

850: Predict a signal of the extension band according to the excitation signal of the extension band and the second envelope of the extension band.

In this embodiment of the present invention, a second envelope of an extension band is received, where the second envelope of the extension band is determined by an encoder end according to a signal-to-noise ratio of a voice or audio signal, a pitch period of the voice or audio signal, and a first envelope of the extension band, so that a decoder end can predict a signal of the extension band according to the second envelope of the extension band and an excitation signal of the extension band, thereby improving performance of the voice or audio signal.

Figure 9:
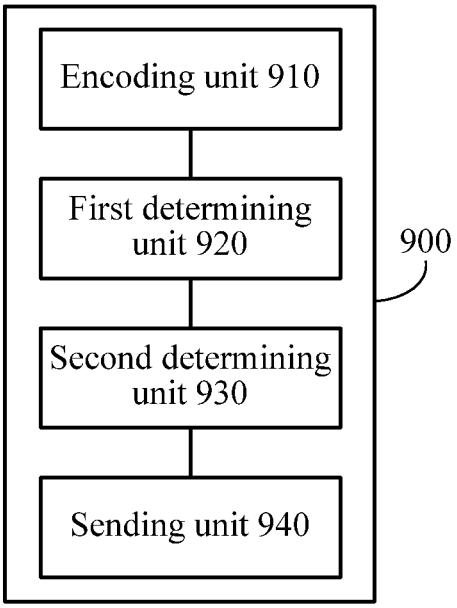
FIG. 9 is a schematic block diagram of a signal encoding device according to an embodiment of the present invention.

FIG. 9 is a schematic block diagram of a signal encoding device according to an embodiment of the present invention. An example of a device 900 in FIG. 9 is an encoder. The device 900 includes an encoding unit 910, a first determining unit 920, a second determining unit 930, and a sending unit 940.

The encoding unit 910 performs core layer encoding on a voice signal or an audio signal, to obtain a core layer bit stream of the voice or audio signal. The first determining unit 920 performs extension layer processing on the voice or audio signal to determine a first envelope of an extension band. The second determining unit 930 determines a second envelope of the extension band according to a signal-to-noise ratio of the voice or audio signal, a pitch period of the voice or audio signal, and the first envelope of the extension band. The encoding unit 910 further encodes the second envelope to obtain an extension layer bit stream. The sending unit 940 sends the core layer bit stream and the extension layer bit stream to a decoder end.

For other functions and operations of the device 900 in FIG. 9, reference may be made to the process of the method embodiment in FIG. 7; to prevent repetition, details are not described herein again.

In this embodiment of the present invention, a first envelope of an extension band is determined, and a second envelope of the extension band is determined according to a signal-to-noise ratio of a voice or audio signal, a pitch period of the voice or audio signal, and the first envelope of the extension band, so that a decoder end can determine a signal of the extension band according to a core layer bit stream and the second envelope of the extension band, thereby improving performance of the voice or audio signal.

Figure 10:
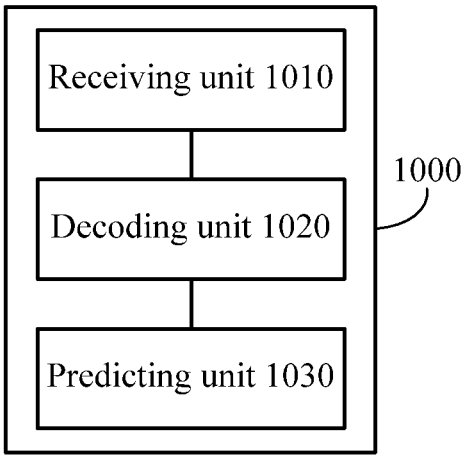
FIG. 10 is a schematic block diagram of a signal decoding device according to an embodiment of the present invention.

FIG. 10 is a schematic block diagram of a signal decoding device according to an embodiment of the present invention. An example of a device woo in FIG. 10 is a decoder. The device woo includes a receiving unit low, a decoding unit 1020, and a predicting unit 1030.

The receiving unit low receives, from an encoder end, a core layer bit stream and an extension layer bit stream of a voice signal or an audio signal. The decoding unit 1020 decodes the extension layer bit stream to determine a second envelope of an extension band, where the second envelope is determined by the encoder end according to a signal-to-noise ratio of the voice or audio signal, a pitch period of the voice or audio signal, and a first envelope of the extension band. The decoding unit 1020 further decodes the core layer bit stream, to obtain a core layer voice or audio signal. The predicting unit 1030 predicts an excitation signal of the extension band according to the core layer voice or audio signal. The predicting unit 1030 predicts a signal of the extension band according to the excitation signal of the extension band and the second envelope of the extension band.

For other functions and operations of the device woo, reference may be made to the process of the method embodiment in FIG. 8; to prevent repetition, details are not described herein again.

In this embodiment of the present invention, a second envelope of an extension band is received, where the second envelope of the extension band is determined by an encoder end according to a signal-to-noise ratio of a voice or audio signal, a pitch period of the voice or audio signal, and a first envelope of the extension band, so that a decoder end can predict a signal of the extension band according to the second envelope of the extension band and an excitation signal of the extension band, thereby improving performance of the voice or audio signal.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present invention essentially, or the part contributing to the prior art, or some of the technical solutions may be implemented in a form of a software product. The computer software product is stored in a storage medium, and includes several instructions for instructing a computer device (which may be a personal computer, a server, or a network device) to perform all or some of the steps of the methods described in the embodiments of the present invention. The foregoing storage medium includes: any medium that can store program code, such as a USB flash drive, a removable hard disk, a read-only memory (ROM), a random access memory (RAM), a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A signal encoding method, comprising:

performing core layer encoding on at least one of a voice signal or an audio signal and obtaining a core layer bit stream of the at least one of the voice or the audio signal from the core layer encoding;

performing extension layer processing on the at least one of the voice or the audio signal and determining a first envelope of an extension band according to the extension layer processing;

modifying the first envelope of the extension band according to a signal-to-noise ratio of the voice or audio signal and a pitch period of the voice or audio signal, so that a second envelope of the extension band is inversely proportional to the signal-to-noise ratio and directly proportional to the pitch period, thereby determining the second envelope of the extension band;

encoding the second envelope and obtaining an extension layer bit stream according to the encoding of the second envelope; and sending the core layer bit stream and the extension layer bit stream to a decoder end.

2. A signal decoding method, comprising:

receiving, from an encoder end, a core layer bit stream and an extension layer bit stream of at least one of a voice or audio signal;

decoding the extension layer bit stream and determining a second envelope of an extension band according to the decoding the extensions layer bit stream, wherein the second envelope is determined by the encoder end by modifying a first envelope of the extension band according to a signal-to-noise ratio of the voice or audio signal and a pitch period of the voice or audio signal, so that the second envelope of the extension band is inversely proportional to the signal-to-noise ratio and directly proportional to the pitch period, thereby determining the second envelope of the extension band;

decoding the core layer bit stream and obtaining a core layer signal of the at least one of the voice or the audio signal according to the decoding the core layer bit stream;

predicting an excitation signal of the extension band according to the core layer signal; and predicting a signal of the extension band according to the excitation signal of the extension band and the second envelope of the extension band.

3. A signal encoding device, comprising:

a processor; and a non-transitory computer-readable storage medium storing a program to be executed by the processor, the program including instructions for:

performing core layer encoding on at least one of a voice signal or an audio signal and obtaining a core layer bit stream of the at least one of the voice or the audio signal from the core layer encoding;

performing extension layer processing on the at least one of the voice or the audio signal and determining a first envelope of an extension band according to the extension layer processing;

modifying the first envelope of the extension band according to a signal-to-noise ratio of the voice or audio signal and a pitch period of the voice or audio signal, so that a second envelope of the extension band is inversely proportional to the signal-to-noise ratio and directly proportional to the pitch period, thereby determining the second envelope of the extension band;

encoding the second envelope and obtaining an extension layer bit stream according to the encoding of the second envelope; and sending the core layer bit stream and the extension layer bit stream to a decoder end.

4. A signal decoding device, comprising:

a processor; and a non-transitory computer-readable storage medium storing a program to be executed by the processor, the program including instructions for:

receiving, from an encoder end, a core layer bit stream and an extension layer bit stream of at least one of a voice or audio signal;

decoding the extension layer bit stream and determining a second envelope of an extension band according to the decoding the extensions layer bit stream, wherein the second envelope is determined by the encoder end by modifying a first envelope of the extension band according to a signal-to-noise ratio of the voice or audio signal and a pitch period of the voice or audio signal, so that the second envelope of the extension band is inversely proportional to the signal-to-noise ratio and directly proportional to the pitch period, thereby determining the second envelope of the extension band;

decoding the core layer bit stream and obtaining a core layer signal of the at least one of the voice or the audio signal according to the decoding the core layer bit stream;

predicting an excitation signal of the extension band according to the core layer signal; and predicting a signal of the extension band according to the excitation signal of the extension band and the second envelope of the extension band.

* * * * *